US010189274B2

(12) United States Patent
Murakami et al.

(10) Patent No.: US 10,189,274 B2
(45) Date of Patent: Jan. 29, 2019

(54) PRINTER, AND METHOD AND COMPUTER-READABLE MEDIUM FOR THE SAME

(71) Applicant: Brother Kogyo Kabushiki Kaisha, Nagoya-shi, Aichi-ken (JP)

(72) Inventors: Sachiko Murakami, Okazaki (JP); Akira Minami, Nagoya (JP); Satoru Ito, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/718,860

(22) Filed: Sep. 28, 2017

(65) Prior Publication Data

US 2018/0178547 A1 Jun. 28, 2018

(30) Foreign Application Priority Data

Dec. 28, 2016 (JP) ..... 2016-255088

(51) Int. Cl.
*B41J 2/355* (2006.01)
*B41J 11/00* (2006.01)

(52) U.S. Cl.
CPC ..... *B41J 2/355* (2013.01); *B41J 11/007* (2013.01)

(58) Field of Classification Search
CPC ..... B41F 16/00; B41F 16/0006; B41J 2/355; B41J 11/007; B41J 2/32; B41J 2/325; B41J 35/16; B41J 35/18
See application file for complete search history.

(56) References Cited

U.S. PATENT DOCUMENTS

2005/0117013 A1* 6/2005 Hayashi ..... B41J 2/355 347/179
2006/0284965 A1* 12/2006 Tsubota ..... B41J 11/008 347/217
2016/0001574 A1* 1/2016 Ishino ..... B41J 2/3551 347/180

FOREIGN PATENT DOCUMENTS

| | | | |
|---|---|---|---|
| JP | S62-087365 | A | 4/1987 |
| JP | H01-154775 | A | 6/1989 |
| JP | H03-155957 | A | 7/1991 |
| JP | H10-217528 | A | 8/1998 |
| JP | 2000-190548 | A | 7/2000 |
| JP | 2014-233930 | A | 12/2014 |

* cited by examiner

*Primary Examiner* — Kristal Feggins
(74) *Attorney, Agent, or Firm* — Banner & Witcoff, Ltd.

(57) ABSTRACT

A printer includes a controller configured to, while conveying a print medium, apply a fourth quantity of thermal energy per unit area to a first area of the print medium and apply a fifth quantity of thermal energy per unit area to a second area that at least partially overlaps the first area in a conveyance direction, the print medium developing a color when supplied with a quantity of thermal energy per unit area equal to or more than a first quantity and equal to or less than a second quantity and developing another color when supplied with a quantity of thermal energy per unit area equal to or more than a third quantity more than the second quantity, the fourth and fifth quantities being more than the first quantity and less than the second quantity, a sum of the fourth and fifth quantities being less than the third quantity.

14 Claims, 11 Drawing Sheets

PRINTER, AND METHOD AND COMPUTER-READABLE MEDIUM FOR THE SAME

CROSS-REFERENCE TO RELATED APPLICATION

This application claims priority under 35 U.S.C. § 119 from Japanese Patent Application No. 2016-255088 filed on Dec. 28, 2016. The entire subject matter of the application is incorporated herein by reference.

BACKGROUND

Technical Field

The following description relates to aspects of a printer, and a method and a computer-readable medium for the printer.

Related Art

Heretofore, a printer has been known that is configured to perform printing using a thermal head while conveying a thermosensitive print medium. In the known printer, when conveyance of the print medium is resumed after once halted during the printing, it might result in deterioration of print quality as a white line might be formed between an image printed before the halt of the print medium conveyance and an image printed after the restart of the print medium conveyance. Therefore, various techniques to prevent formation of such a white line have been proposed. One of the proposed techniques is a method in which when resuming conveyance of the print medium, the printer once conveys the print medium in a forward direction and a backward direction along a conveyance direction, then switches a traveling direction of the print medium to the forward direction, and performs printing using the thermal head while conveying the print medium in the forward direction.

SUMMARY

When printing is performed in the aforementioned method, a part of the print medium might be redundantly heated by the thermal head both before the halt of the print medium conveyance and after the restart of the print medium conveyance. In this case, a quantity of thermal energy applied to the redundantly-heated part of the print medium is larger than a quantity of thermal energy applied to the other part of the print medium. Hence, there might be a difference in color development conditions between the redundantly-heated part and the other part of the print medium. Particularly, in use of a print medium configured to develop a plurality of colors in accordance with a quantity of thermal energy applied thereto, different colors might be developed between the redundantly-heated part and the other part of the print medium. In such a case, print quality is more deteriorated than when a print medium configured to develop a single color is used.

Aspects of the present disclosure are advantageous to provide one or more improved techniques, for a printer, which make it possible to avoid formation of a white line and prevent development of different colors between a redundantly-heated part and the other part of a print medium.

According to aspects of the present disclosure, a printer is provided that includes a thermal head having a plurality of heating elements arranged in an arrangement direction, the thermal head being configured to selectively energize the plurality of heating elements, thereby applying thermal energy to a print medium, the print medium being configured to develop a first color when supplied with a quantity of thermal energy per unit area that is equal to or more than a first quantity and equal to or less than a second quantity and to develop a second color when supplied with a quantity of thermal energy per unit area that is equal to or more than a third quantity more than the second quantity, a conveyor configured to convey the print medium in a conveyance direction perpendicular to the arrangement direction of the heating elements, and a controller configured to perform a particular process. The particular process includes, while controlling the conveyor to convey the print medium, controlling the thermal head to apply a fourth quantity of thermal energy per unit area to a first area of the print medium, and while controlling the conveyor to convey the print medium, controlling the thermal head to apply a fifth quantity of thermal energy per unit area to a second area of the print medium, the second area including an overlapping area that overlaps and positionally coincides with at least a part of the first area in the conveyance direction, each of the fourth quantity and the fifth quantity being more than the first quantity and less than the second quantity, a sum of the fourth quantity and the fifth quantity being less than the third quantity.

According to aspects of the present disclosure, further provided is a method implementable on a processor coupled with a printer. The printer includes a thermal head having a plurality of heating elements arranged in an arrangement direction, the thermal head being configured to selectively energize the plurality of heating elements, thereby applying thermal energy to a print medium, the print medium being configured to develop a first color when supplied with a quantity of thermal energy per unit area that is equal to or more than a first quantity and equal to or less than a second quantity and to develop a second color when supplied with a quantity of thermal energy per unit area that is equal to or more than a third quantity more than the second quantity, and a conveyor configured to convey the print medium in a conveyance direction perpendicular to the arrangement direction of the heating elements. The method includes, while controlling the conveyor to convey the print medium, controlling the thermal head to apply a fourth quantity of thermal energy per unit area to a first area of the print medium, and while controlling the conveyor to convey the print medium, controlling the thermal head to apply a fifth quantity of thermal energy per unit area to a second area of the print medium, the second area including an overlapping area that overlaps and positionally coincides with at least a part of the first area in the conveyance direction, each of the fourth quantity and the fifth quantity being more than the first quantity and less than the second quantity, a sum of the fourth quantity and the fifth quantity being less than the third quantity.

According to aspects of the present disclosure, further provided is a non-transitory computer-readable medium storing computer-readable instructions that are executable by a processor coupled with a printer. The printer includes a thermal head having a plurality of heating elements arranged in an arrangement direction, the thermal head being configured to selectively energize the plurality of heating elements, thereby applying thermal energy to a print medium, the print medium being configured to develop a first color when supplied with a quantity of thermal energy per unit area that is equal to or more than a first quantity and equal to or less than a second quantity and to develop a second color when supplied with a quantity of thermal energy per unit area that is equal to or more than a third quantity more than the second quantity, and a conveyor configured to convey the print medium in a conveyance direction perpendicular to the arrangement direction of the heating elements, the instructions being configured to, when executed by the processor, cause the processor to perform a particular process. The particular process includes, while controlling the conveyor to convey the print medium, controlling the thermal head to apply a fourth quantity of thermal energy per unit area to a first area of the print medium, and while controlling the conveyor to convey the print medium, controlling the thermal head to apply a fifth quantity of thermal energy per unit area to a second area of the print medium, the second area including an overlapping area that overlaps and positionally coincides with at least a part of the first area in the conveyance direction, each of the fourth quantity and the fifth quantity being more than the first quantity and less than the second quantity, a sum of the fourth quantity and the fifth quantity being less than the third quantity.

BRIEF DESCRIPTION OF THE ACCOMPANYING DRAWINGS

Figure 5:
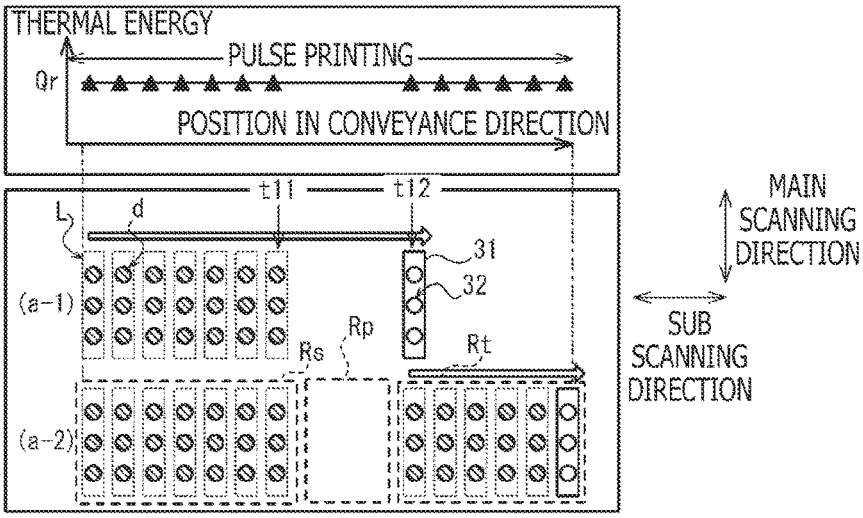

FIG. 5 schematically shows a plurality of lines formed when a "relative position shift" occurs in pulse printing, in the first illustrative embodiment according to one or more aspects of the present disclosure.

Figure 6A:
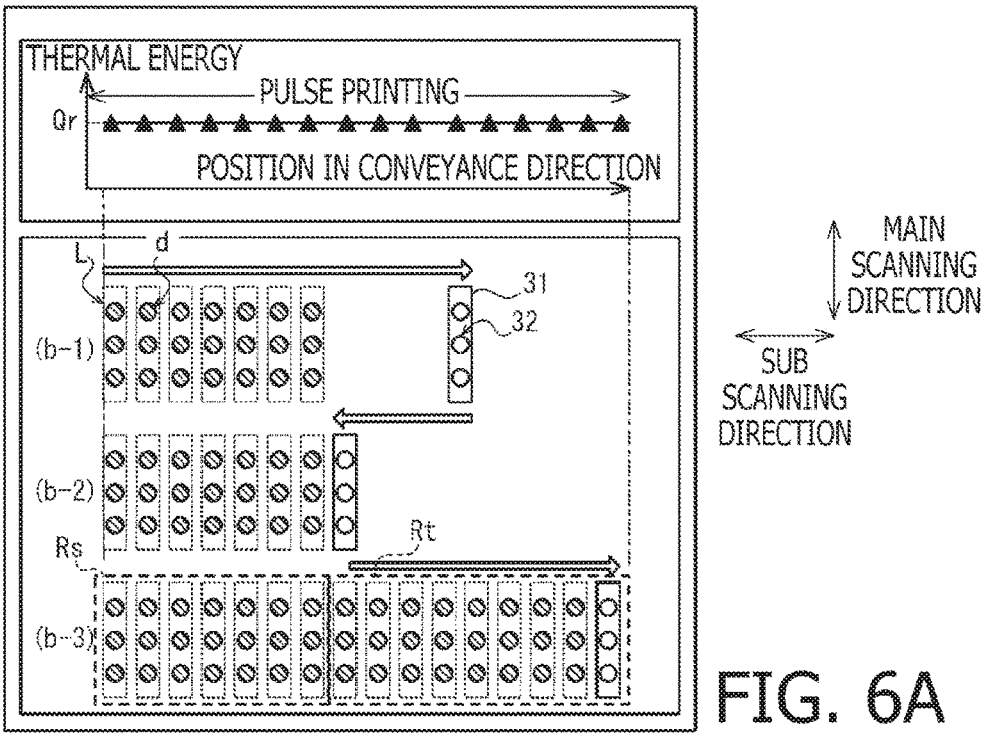
Figure 6B:
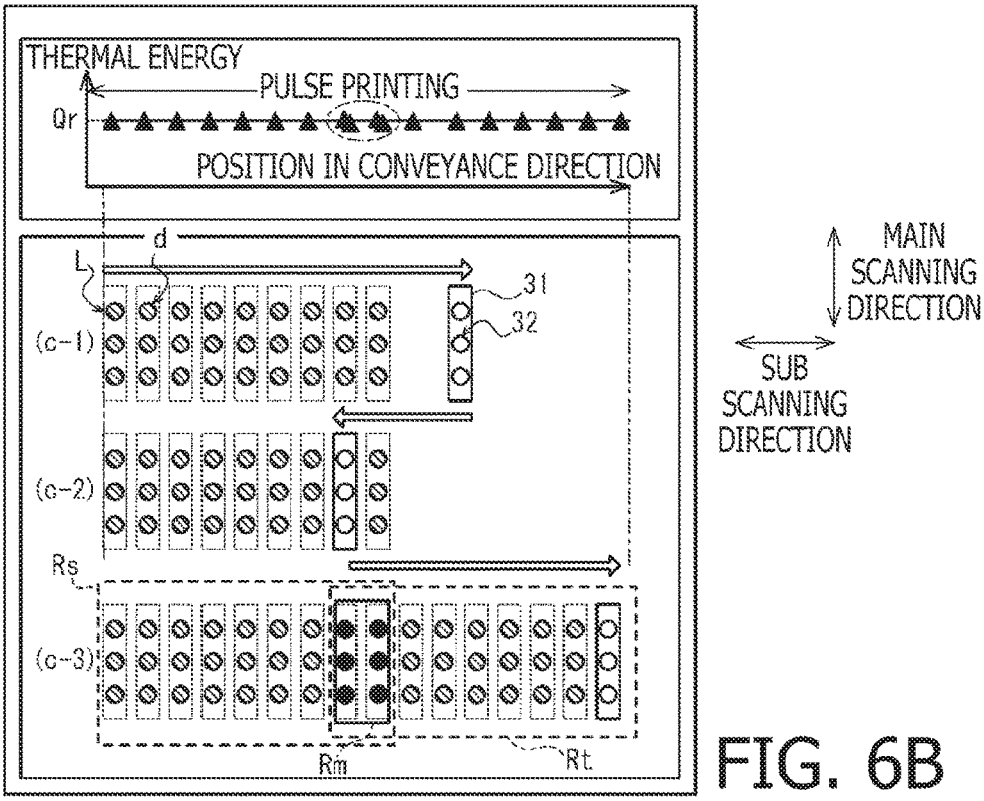

FIGS. 6A and 6B are illustrations each schematically showing a plurality of lines formed when a connection process is performed in the pulse printing, in the first illustrative embodiment according to one or more aspects of the present disclosure.

Figure 7:
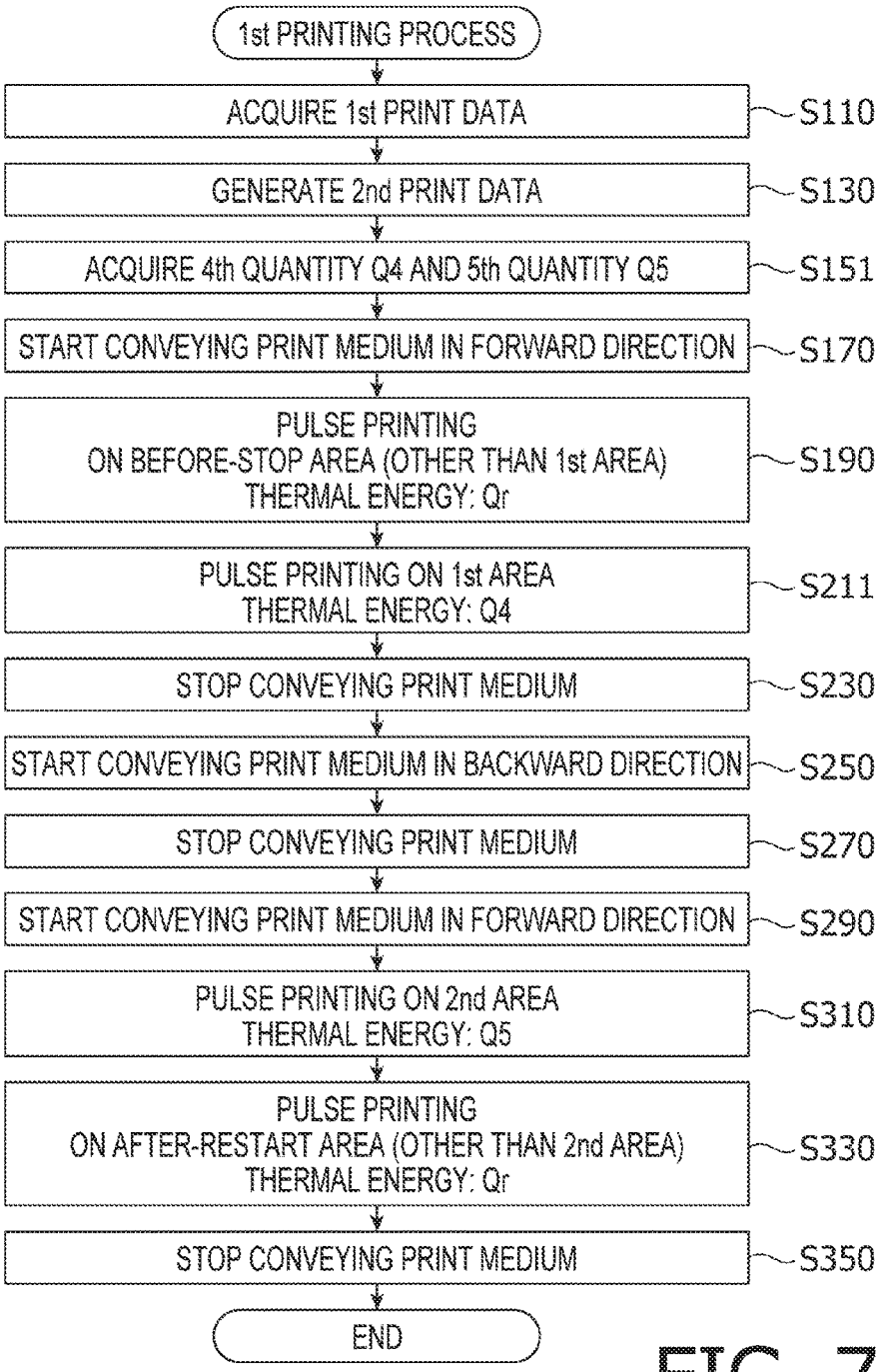

FIG. 7 is a flowchart showing a procedure of a first printing process in the first illustrative embodiment according to one or more aspects of the present disclosure.

Figure 8:
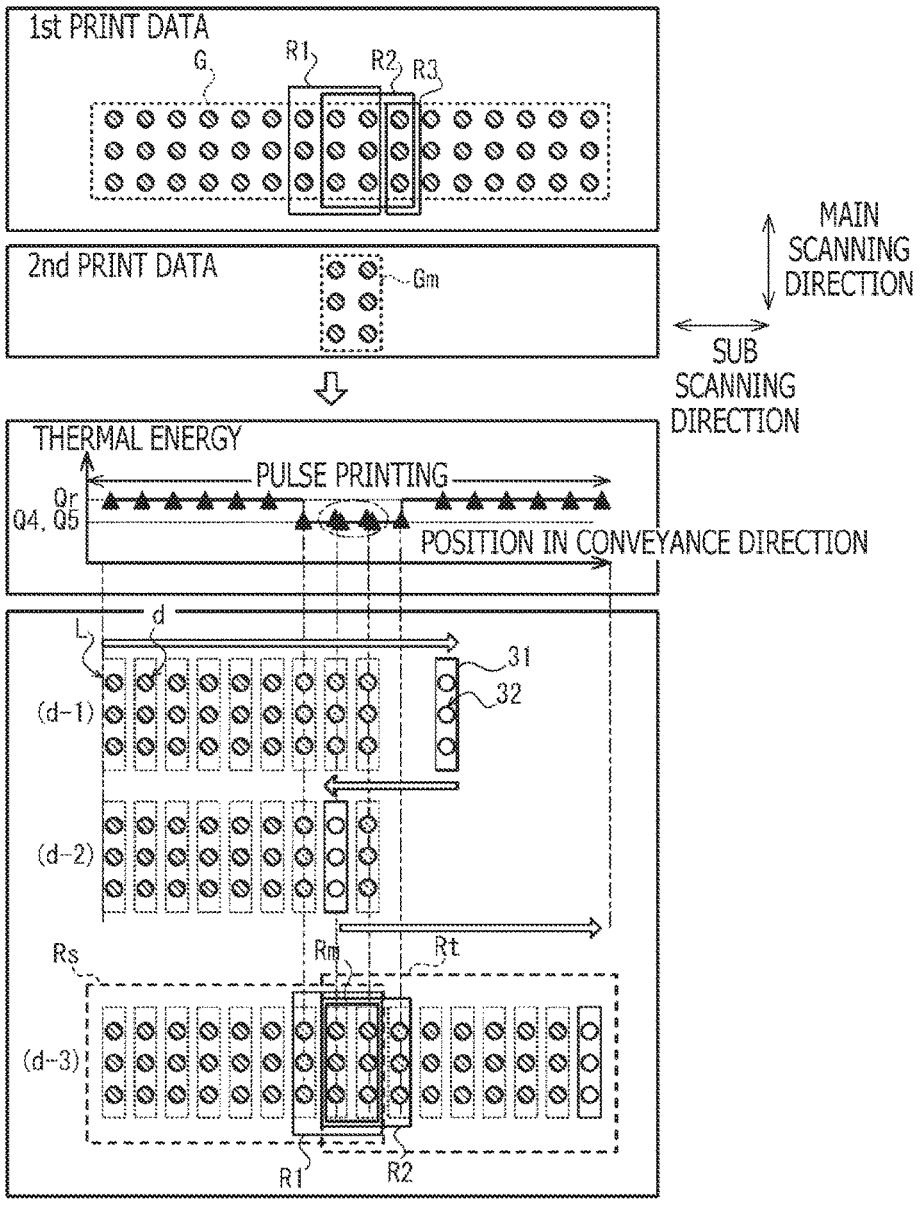

FIG. 8 schematically shows a plurality of lines formed when the connection process is performed in the pulse printing during the first printing process, in the first illustrative embodiment according to one or more aspects of the present disclosure.

Figure 9:
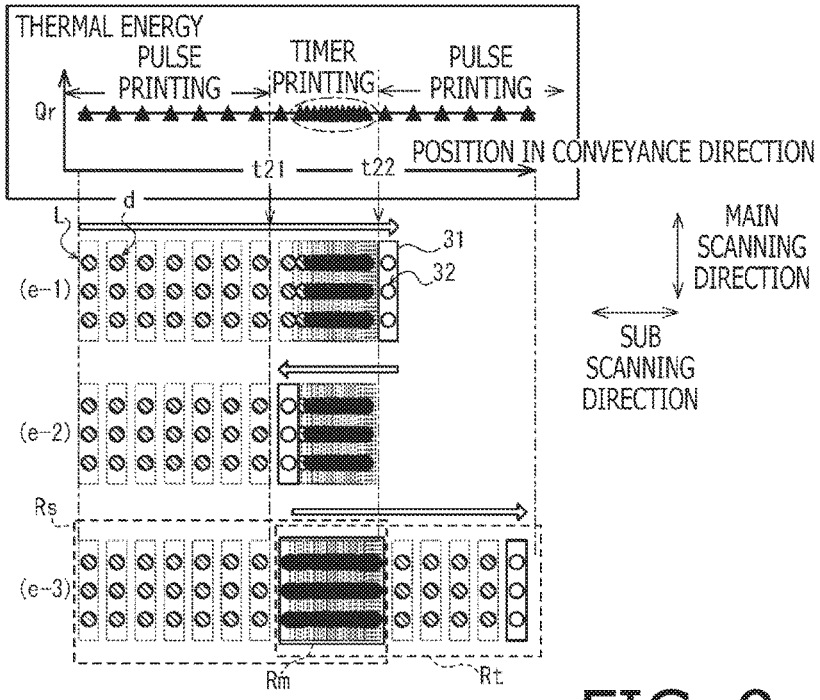

FIG. 9 schematically shows a plurality of lines formed when the connection process is performed in timer printing, in the first illustrative embodiment according to one or more aspects of the present disclosure.

Figure 10:
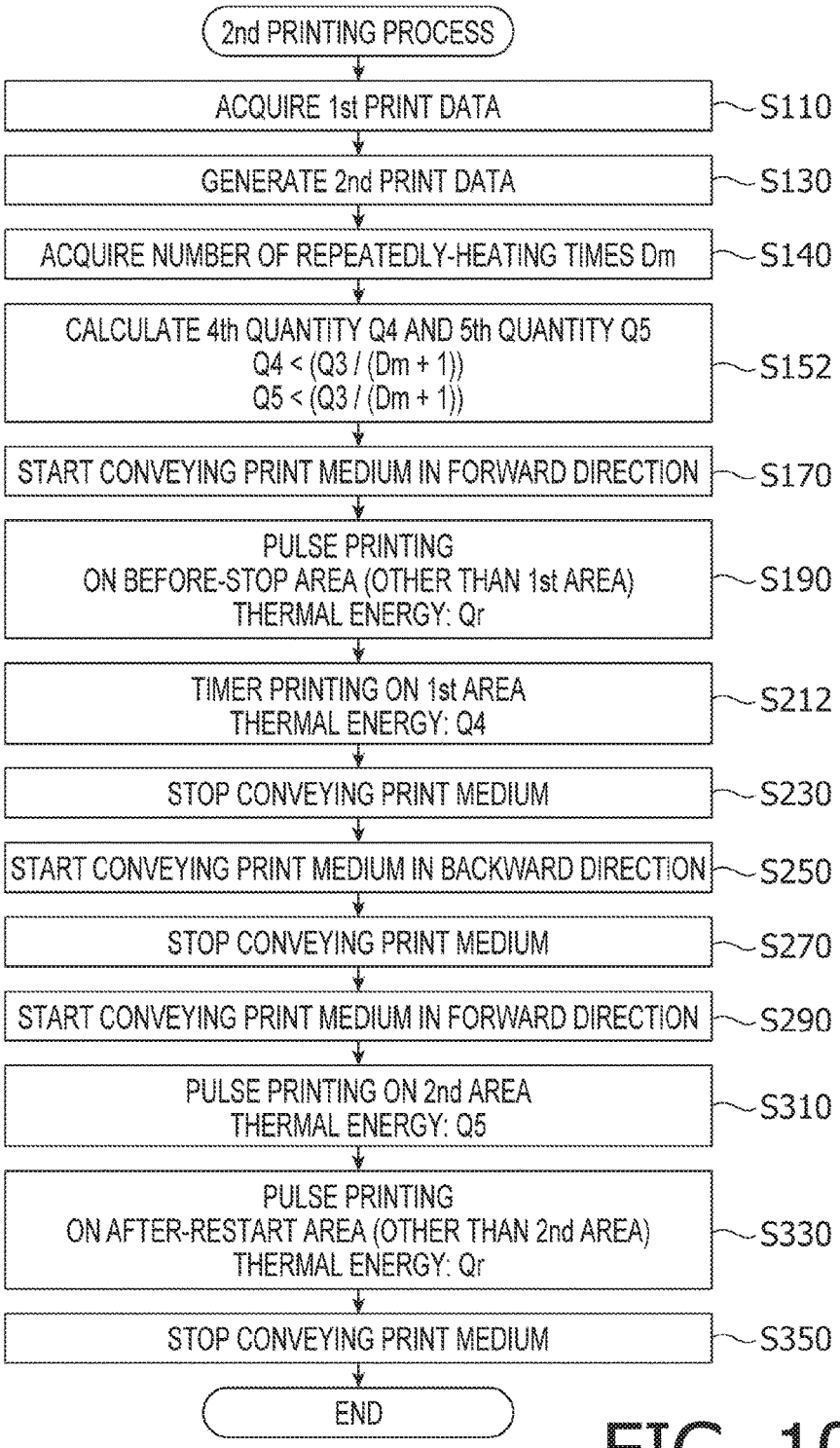

FIG. 10 is a flowchart showing a procedure of a second printing process in a second illustrative embodiment according to one or more aspects of the present disclosure.

Figure 11:
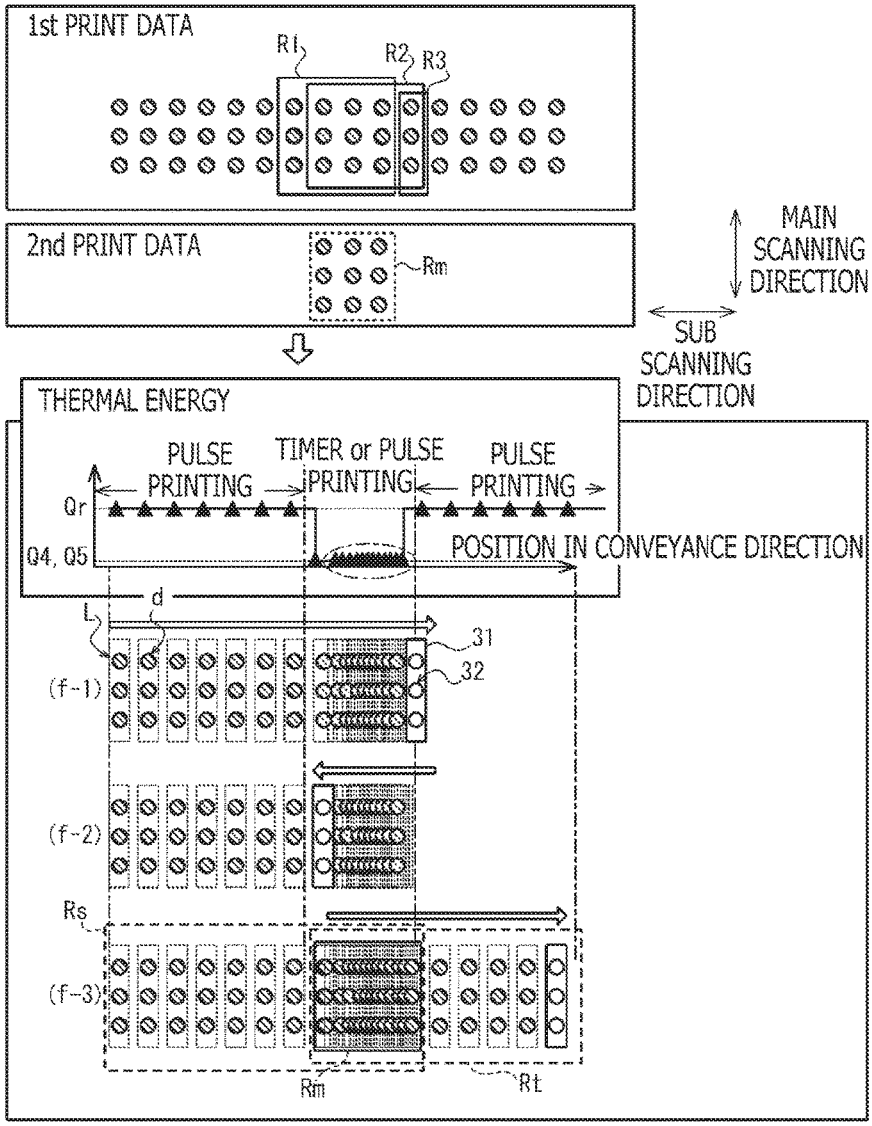

FIG. 11 schematically shows a plurality of lines formed when the connection process is performed in the timer printing (or the pulse printing) during the second printing process, in the second illustrative embodiment according to one or more aspects of the present disclosure.

DETAILED DESCRIPTION

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storage, hard disk drives, floppy drives, permanent storage, and the like.

First Illustrative Embodiment

Hereinafter, an illustrative embodiment according to aspects of the present disclosure will be described with reference to the accompanying drawings. The drawings to be referred to in the following description are used to schematically show and set forth technical features according to aspects of the present disclosure. Nonetheless, the technical features shown in the drawings such as a configuration of an apparatus and flowcharts of various processes are just examples but are not limited to the ones exemplified in the drawings. In the following description, a lower right side, an upper left side, an upper right side, a lower left side, an upper side, and a lower side in FIG. 1 will be defined as a right side, a left side, a rear side, a front side, an upside and a downside of a printer 1, respectively. These directional definitions shall apply to descriptions referring to FIG. 2 and the subsequent drawings.

<Overview of Printer>

Figure 1:
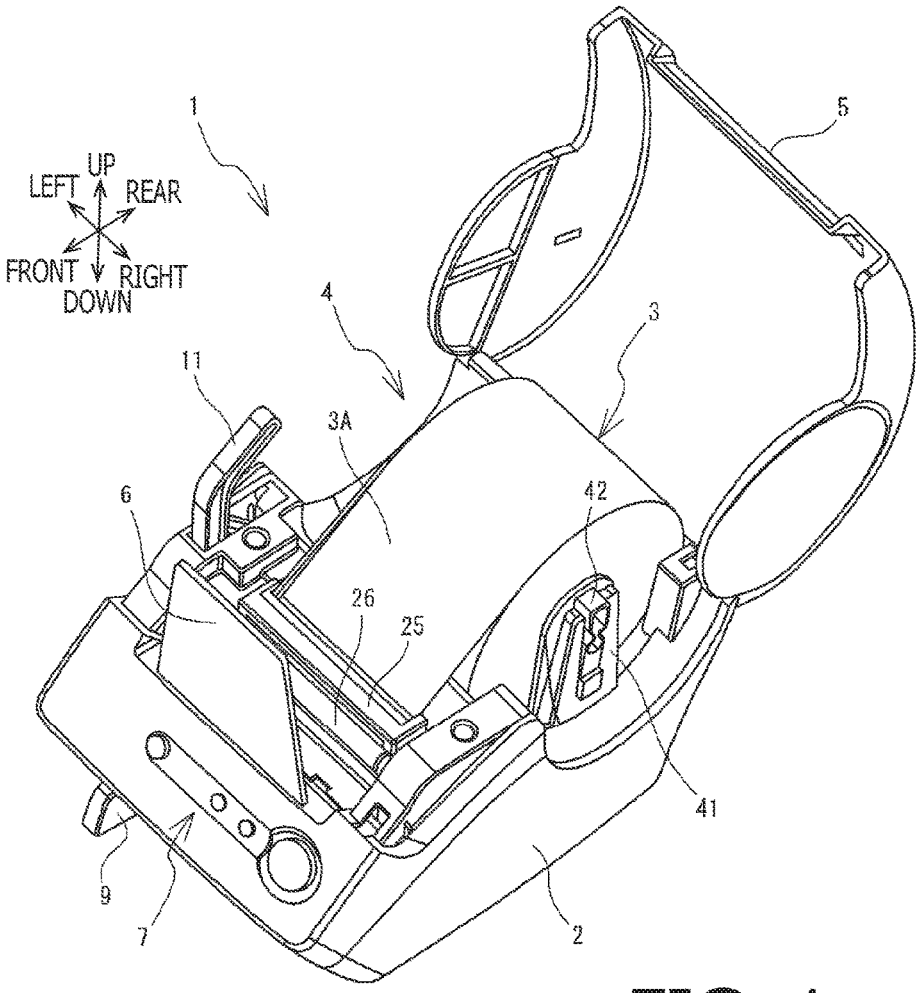
FIG. 1 is a perspective view showing a printer in a state where a cover is open, in a first illustrative embodiment according to one or more aspects of the present disclosure.
Figure 2:
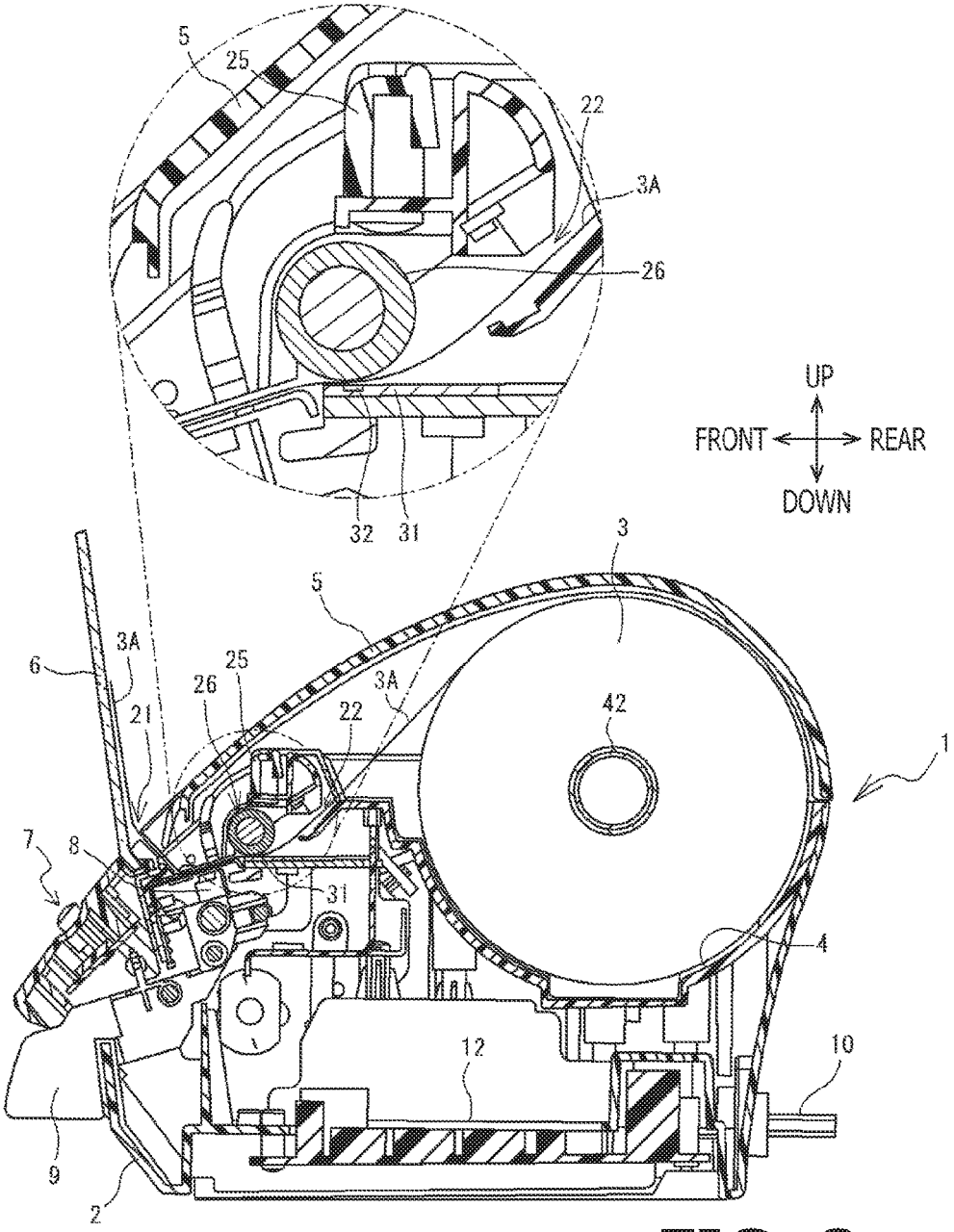
FIG. 2 is a cross-sectional side view showing the printer in a state where the cover is closed, in the first illustrative embodiment according to one or more aspects of the present disclosure.

As shown in FIGS. 1 and 2, the printer 1 is configured to perform two-color printing to cause a print medium 3A to selectively develop one of two colors on a dot-by-dot basis, by controlling a quantity of thermal energy per unit area that is applied to the print medium 3A by each of heating elements 32 (see FIG. 2) of a thermal head 31. The print medium 3A includes one or more thermosensitive color developable layers laminated on a base material layer. The print medium 3A may have two thermosensitive color developable layers each of which is a specific layer configured to develop a corresponding one of the two colors. Alternatively, the print medium 3A may have a single thermosensitive color developable layer configured to develop the two colors. The printer 1 has a rolled sheet 3 as the long print medium 3A wound in a roll shape, within a housing 2. The printer 1 performs printing while pulling the print medium 3A out of the rolled sheet 3.

The printer 1 is configured to connect with an external terminal (not shown) via a USB cable ("USB" is an abbreviated form of "Universal Serial Bus"). For instance, the external terminal may be a general personal computer (hereinafter simply referred to as a "PC"), a mobile terminal, or a tablet terminal. A CPU (not shown) of the external terminal executes a driver program (not shown) installed in the external terminal, thereby generating first print data from image data. In order to express a plurality of pixels forming the image data with a plurality of dots on the print medium 3A, the first print data includes a plurality of pieces of dot data into which the image data is resolved to associate each piece of pixel data of the image data with a corresponding piece of dot data of the first print data.

The printer 1 includes the housing 2 formed in a box shape with an open upper side. The housing 2 is formed in a rectangular shape in each of a front view and a plane view. The housing 2 is elongated in a front-to-rear direction. The open upper side of the housing 2 is covered with a cover 5. A rear part of each of left and right side portions of the housing 2 is open and covered with the cover 5. The cover 5 is rotatably supported by a rear end portion of the housing 2. The cover 5 is configured to swing around a rotation axis extending in a left-to-right direction in such a manner that a front end portion of the cover 5 moves up and down. Thus, the housing 2 is open or closed in response to the swing motion of the cover 5. The housing 2 has a cut lever 9 at a front surface thereof. The cut lever 9 is movable in the left-to-right direction. The cut lever 9 is connected with a cutter unit 8 (see FIG. 2). In response to movement of the cut lever 9 in the left-to-right direction, the cutter unit 8 moves in the left-to-right direction to cut the printed print medium 3A. At an upper surface of a front end portion of the housing 2, input keys 7 are disposed. The input keys 7 include a power switch. Behind the input keys 7 (i.e., at a rear side of the input keys 7), a plate-shaped tray 6 made of transparent resin is erected. Behind the tray 6, a discharge port 21 (see FIG. 2) is disposed. The discharge port 21 is elongated in the left-to-right direction. The discharge port 21 is formed by the front end portion of the cover 5 and the housing 2. The tray 6 is configured to receive the printed print medium 3A discharged via the discharge port 21. At a lower portion of a rear surface of the housing 2, a connector (not shown) is disposed that is connectable with a power cord 10 (see FIG. 2). Further, at the lower portion of the rear surface of the housing 2, a connector (not shown) is disposed that is connectable with a USB cable (not shown) for connecting the printer 1 with the PC 70.

As shown in FIG. 2, a sheet storage 4 is disposed at a rear portion inside the housing 2. The sheet storage 4 is formed to be recessed downward in an arc shape in a side view (when viewed in the left-to-right direction). The rolled sheet 3 (i.e., the print medium 3A wound in a roll shape) is set into the sheet storage 4. The rolled sheet 3 is wound with a printable surface as an inner side, and is held by a tape spool 42. The tape spool 42 engages with supporters 41 (see FIG. 1) erected at a left portion and a right portion of the sheet storage 4. Thus, the rolled sheet 3 is supported by the tape spool 42 to be rotatable in the sheet storage 4. When the cover 5 is open, the tape spool 42 is detachably attached to the supporters 41. A control board 12 is disposed below the sheet storage 4. The control board 12 has a CPU 51 (see FIG. 3) mounted thereon. The CPU 51 is configured to take overall control of the printer 1.

A lever 11 (see FIG. 1) is disposed at a front left side relative to the sheet storage 4. At a right side relative to the lever 11, a roller holder 25 is disposed. The roller holder 25 extends in the left-to-right direction. The roller holder 25 is configured to rotatably hold a platen roller 26. The lever 11 is always urged upward by a coil spring (not shown). When the cover 5 is closed, the lever 11 is pressed down by the cover 5. The lever 11 is connected with the roller holder 25. In conjunction with the lever 11 swinging up and down, the roller holder 25 moves up and down around a rear end thereof as a supporting point. In response to the lever 11 swinging down, the roller holder 25 moves downward. The platen roller 26 presses the print medium 3A pulled out of the rolled sheet 3, toward the thermal head 31. In this case, the printer 1 is brought into a printable state. In response to the cover 5 being opened, the lever 11 swings up, and thereby the roller holder 25 is moved upward. The platen roller 26 held by the roller holder 25 is separated from the thermal head 31 and the print medium 3A. In this case, the printer 1 is brought into an unprintable state.

The housing 2 includes a conveyance path 22. The conveyance path 22 is for conveying the print medium 3A pulled out of the rolled sheet 3, obliquely toward a lower front side from a front end of the sheet storage 4. The conveyance path 22 passes between the platen roller 26 and the thermal head 31, and extends up to the discharge port 21. The printer 1 is configured to perform printing on the print medium 3A while conveying the print medium 3A from the sheet storage 4 to the discharge port 21. In the following description, a direction in which the print medium 3A is conveyed along and within the conveyance path 22 may be referred to as a "conveyance direction." A direction toward the discharge port 21 from the rolled sheet 3 along the conveyance direction may be referred to as a "forward direction." A direction toward the rolled sheet 3 from the discharge port 21 along the conveyance direction may be referred to as a "backward direction."

The platen roller 26 and the thermal head 31 are disposed substantially at a middle portion of the conveyance path 22. The thermal head 31 is configured to form a dot by heating the print medium 3A to develop a color of dye contained in the print medium 3A. The thermal head 31 is formed in a plate shape. The thermal head 31 includes a plurality of heating elements 32 in an upper surface thereof. The heating elements 32 are arranged in line along a main scanning direction (i.e., the left-to-right direction) perpendicular to the conveyance direction of the print medium 3A. For instance, in the illustrative embodiment, the thermal head 31 includes 360 heating elements 32 arranged in line along the main scanning direction. It is noted that in a position where the thermal head 31 is disposed, a direction perpendicular to the main scanning direction along which the heating elements 32 are arranged may be referred to as a "sub scanning direction." The sub scanning direction is coincident with the conveyance direction near the heating elements 32. Thermal head 31 is provided with a thermistor 33 (see FIG. 3) configured to detect a temperature of the thermal head 31.

The platen roller 26 is rotatably supported by the roller holder 25. The platen roller 26 is disposed above the thermal head 31. The platen roller 26 is disposed in such a manner that an axial direction thereof is coincident with the main scanning direction parallel to the arrangement of the heating elements 32. Further, the platen roller 26 is opposed to the heating elements 32. The platen roller 26 is urged toward the thermal head 31 by the roller holder 25. The platen roller 26 is connected with a conveyance motor 60 (see FIG. 3) via one or more gears (not shown). The platen roller 26 is driven to rotate by the conveyance motor 60. The platen roller 26 and the thermal head 31 pinch the print medium 3A therebetween. Thus, the print medium 3A is conveyed along the conveyance direction.

<Electrical Configuration of Printer>

Figure 3:
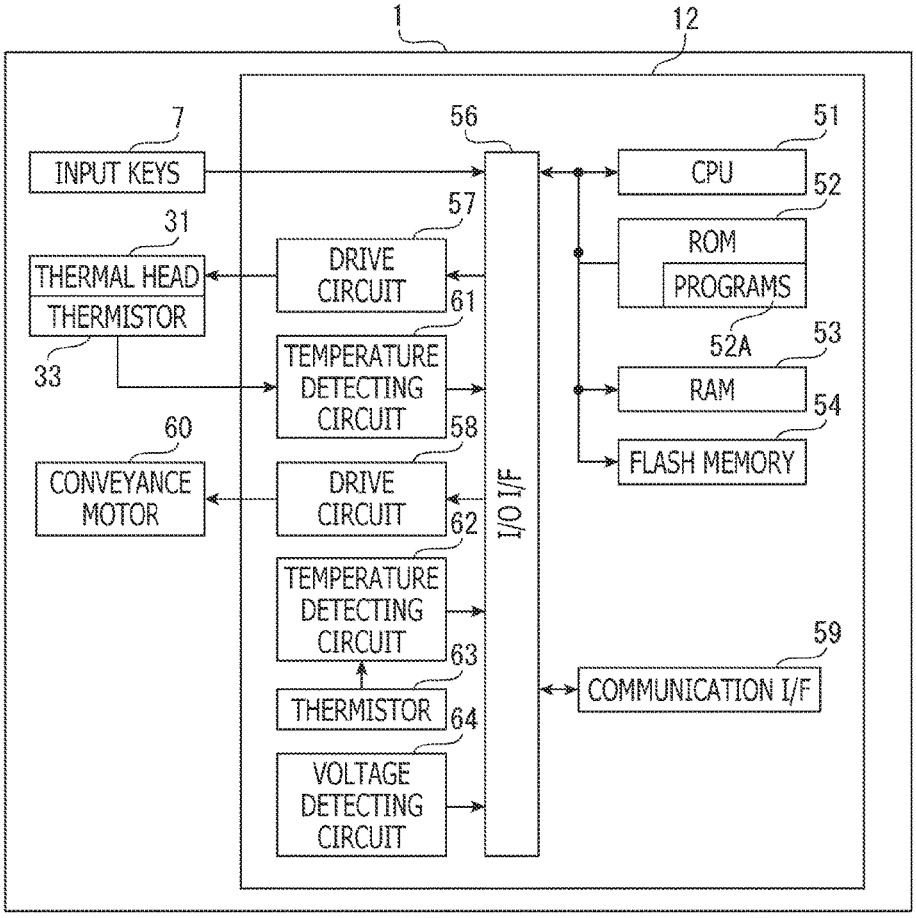
FIG. 3 is a block diagram showing an electrical configuration of the printer in the first illustrative embodiment according to one or more aspects of the present disclosure.

Referring to FIG. 3, an electrical configuration of the printer 1 will be described. The printer 1 includes the CPU 51 configured to control the printer 1. The CPU 51 is connected with a ROM 52, a RAM 53, and a flash memory 54. The ROM 52 is configured to store programs 52A executable by the CPU 51. Further, the ROM 52 stores a first quantity Q1, a second quantity Q2, a third quantity Q3, a fourth quantity Q4, a fifth quantity Q5, and a number of repeatedly-heating times Dm. The first quantity Q1, the second quantity Q2, the third quantity Q3, the fourth quantity Q4, the fifth quantity Q5, and the number of repeatedly-heating times Dm will be described later. The RAM 53 is configured to store various kinds of temporary data. The flash memory 54 is configured to store the first print data received from the external terminal.

The CPU 51 is connected, via an input-output interface (hereinafter referred to as an "I/O I/F") 56, with the input keys 7, drive circuits 57 and 58, a communication interface (hereinafter referred to as a "communication I/F") 59, and temperature detecting circuits 61 and 62. The input keys 7 disposed at the upper surface of the printer 1 are configured to accept user operations. The drive circuit 57 is configured to supply electricity to each heating element 32 of the thermal head 31, thereby applying a corresponding quantity of thermal energy to each heating element 32. The CPU 51 controls energization of each individual heating element 32 via the drive circuit 57. The drive circuit 58 is configured to drive the conveyance motor 60. The conveyance motor 60 may be a pulse motor. The CPU 51 transmits pulse signals to the conveyance motor 60 via the drive circuit 58, thereby rotating the platen roller 26. Thus, the print medium 3A is conveyed on a line-by-line basis at a particular speed. It is noted that each single line is formed by a plurality of dots arranged in line.

The temperature detecting circuit 61 is configured to detect a temperature of the thermal head 31 with the thermistor 33 provided to the thermal head 31. The temperature detecting circuit 62 is configured to detect a temperature of the control board 12 on which electronic circuits including the CPU 51 are mounted, with a thermistor 63 provided to the control board 12. The communication I/F 59 is configured to perform communication with the external terminal via the USB cable (not shown). The printer 1 receives print data from the external terminal via the USB cable. The communication I/F 59 may be configured to communicate with the external terminal via a wireless connection such as Bluetooth (trademark registered) and Wi-Fi (trademark registered).

<Overview of Printing Operation>

The CPU 51 of the printer 1 selectively energizes the heating elements 32 of the thermal head 31. Thermal energy is applied to contact portions of the print medium 3A that are in contact with the energized heating elements 32. Thereby, the CPU forms a plurality of dot rows each of which includes a plurality of dots arranged in line corresponding to arrangement of the energized heating elements 32. A dot row is referred to as a "line."

The CPU 51 intermittently energizes the heating elements 32 a plurality of times while rotating the platen roller 26 by the conveyance motor 60 to convey the print medium 3A in the forward direction. Thereby, thermal energy is intermittently applied the plurality of times to the print medium 3A being conveyed in the forward direction. Consequently, a plurality of lines are formed on the print medium 3A, arranged in a line arrangement direction perpendicular to a dot arrangement direction in which a plurality of dots are arranged in each single line. The lines express shading according to existence/nonexistence of each individual dot, thereby forming a printed image of characters and picture images on the print medium 3A. Hereinafter, the aforementioned operations may be referred to as a "printing operation." In addition, the dot arrangement direction of each single line formed on the print medium 3A by the printing operation may be referred to as the main scanning direction (see e.g., FIG. 5) for the sake of explanatory convenience. Further, the line arrangement direction of the lines formed on the print medium 3A may be referred to as the sub scanning direction (see e.g., FIG. 5) for the sake of explanatory convenience.

<Overview of Pulse Printing>

When performing the printing operation, the CPU 51 may intermittently energize the heating elements 32 in synchronization with the pulse signals transmitted from the drive circuit 58 to the conveyance motor 60. It is noted that in response to the pulse signals transmitted from the drive circuit 58 to the conveyance motor 60, the conveyance motor 60 rotates, and the platen roller 26 rotates. Further, in response to intermittent energization of the heating elements 32, thermal energy is intermittently applied to the print medium 3A by the heating elements 32. Namely, the thermal energy may be intermittently applied to the print medium 3A by the heating elements 32, in synchronization with the print medium 3A being conveyed by the rotation of the platen roller 26. Hereinafter, the aforementioned printing operation may be referred to as "pulse printing." A plurality of lines formed by the thermal energy being intermittently applied to the print medium 3A may overlap each other, or may not overlap each other. In any case, the plurality of lines are formed at regular intervals of a particular distance, and it results in a uniform tone of each color. Instead of the pulse printing, the CPU 51 may perform a below-mentioned timer printing. The timer printing will be described in a below-mentioned second illustrative embodiment.

<Characteristics of Print Medium>

When thermal energy is applied to the print medium 3A by the heating elements 32 of the thermal head 31, each of heated spots of the print medium 3A to which the thermal energy has been applied develops a color as a temperature of each heated spot rises. The color of each heated spot is red or black depending on a quantity of energy applied to a corresponding heating element 32 (i.e., a quantity of thermal energy per unit area applied to the print medium 3A).

Figure 4A:
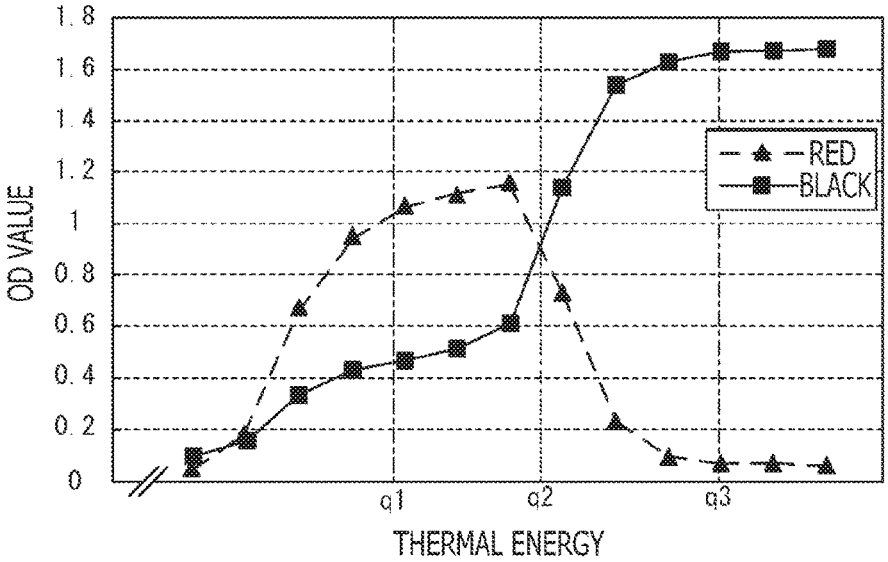
FIG. 4A is a graph showing a relationship between a quantity of thermal energy applied to each heating element of a thermal head of the printer and an optical density (hereinafter referred to as an "OD value") of a developed color of a corresponding heated spot of a print medium, in the first illustrative embodiment according to one or more aspects of the present disclosure.

FIG. 4A is a graph showing a relationship between a quantity of thermal energy applied to each heating element 32 of the thermal head 31 and an optical density (hereinafter referred to as an "OD value") of the red color or the black color of a corresponding heated spot of the print medium 3A. When the quantity of thermal energy applied to each heating element 32 is relatively small, the heated spot of the print medium 3A develops the red color. Meanwhile, when the quantity of thermal energy applied to each heating element 32 is relatively large, the heated spot of the print medium 3A develops the black color. Specifically, when the quantity of thermal energy applied to each heating element 32 is equal to or more than q1 and equal to or less than q2 (where q1<q2), a contact portion (i.e., a heated spot) of the print medium 3A that is in contact with each heating element 32 develops the red color. Meanwhile, when the quantity of thermal energy applied to each heating element 32 is more than q3 (where q2<q3), the contact portion of the print medium 3A that is in contact with each heating element 32 develops the black color. It is noted that among the three quantities q1, q2, and q3, a relationship of "q1<q2<q3" is satisfied.

A quantity Qt of thermal energy applied to the print medium 3A is represented by the following expression (1-1) using a quantity q of thermal energy applied to each heating element 32.

$$Qt=q-E \tag{1-1}$$

E represents a quantity of thermal energy discharged outside without being applied to the print medium 3A, of the thermal energy applied to each heating element 32. Further, a quantity Qs of thermal energy per unit area that is applied to a contact portion of the print medium 3A in contact with each heating element 32 is represented by the following expression (1-2).

$$Qs = \frac{Qt}{S} = \frac{q-E}{S} \tag{1-2}$$

S represents an area occupied by an image of a single pixel. Therefore, when the quantity of thermal energy applied to each heating element 32 is equal to q1, a quantity Q1 of thermal energy per unit area that is applied to the contact portion of the print medium 3A in contact with each heating element 32 is represented by an expression "(q1−E)/S" (i.e., Q1=(q1−E)/S). Likewise, when the quantity of thermal energy applied to each heating element 32 is equal to q2, a quantity Q2 of thermal energy per unit area that is applied to the contact portion of the print medium 3A in contact with each heating element 32 is represented by an expression "(q2−E)/S" (i.e., Q2=(q2−E)/S). Furthermore, when the quantity of thermal energy applied to each heating element 32 is equal to q3, a quantity Q3 of thermal energy per unit area that is applied to the contact portion of the print medium 3A in contact with each heating element 32 is represented by an expression "(q3−E)/S" (i.e., Q3=(q3−E)/S).

Namely, when the quantity of thermal energy per unit area that is applied to the contact portion of the print medium 3A in contact with each heating element 32 is equal to or more than Q1 and equal to or less than Q2 (where Q1<Q2), the print medium 3A develops the red color. Meanwhile, when the quantity of thermal energy per unit area that is applied to the contact portion of the print medium 3A in contact with each heating element 32 is more than Q3 (where Q2<Q3), the print medium 3A develops the black color. It is noted that among the three quantities Q1, Q2, and Q3, a relationship of "Q1<Q2<Q3" is satisfied. Hereinafter, Q1, Q2, and Q3 may be referred to as a "first quantity," a "second quantity," and a "third quantity." Further, a quantity of thermal energy per unit area that is applied to the contact portion of the print medium 3A in contact with each heating element 32 may be simply referred to as "thermal energy per unit area applied to the print medium 3A."

Figure 4B:
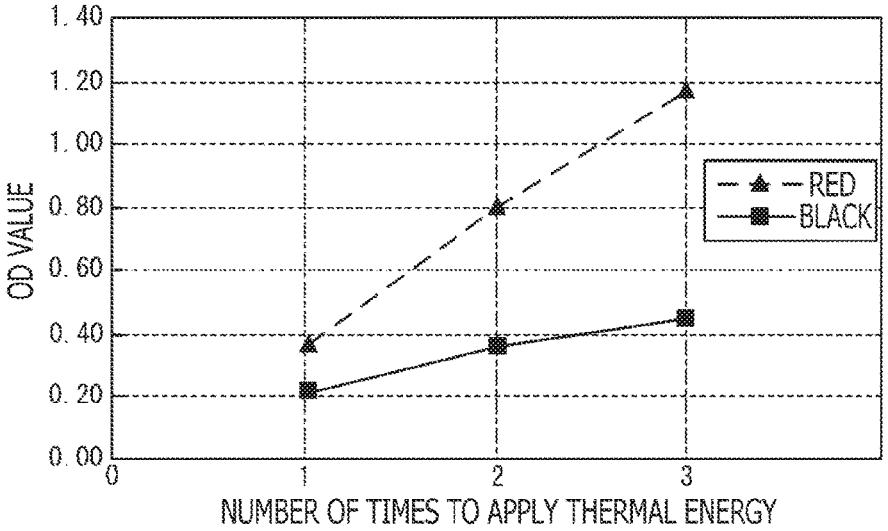
FIG. 4B is a graph showing a relationship between the number of times to apply to each heating element a predetermined quantity of thermal energy and the OD value of the developed color of the corresponding heated spot of the print medium, in the first illustrative embodiment according to one or more aspects of the present disclosure.

FIG. 4B is a graph showing a relationship between the number of times to apply to each heating element 32 a predetermined quantity (about 139 μJ of thermal energy and the OD value of the red color or the black color. The relationship shown in the graph also corresponds to a relationship between the number of times to apply to the print medium 3A a particular quantity of thermal energy per unit area and the OD value of the red color or the black color. The OD value substantially linearly increases along with an increase in the number of times to apply to each heating element 32 the predetermined quantity of thermal energy. Therefore, when a quantity of thermal energy per unit area is applied to a specific portion of the print medium 3A a plurality of times, the specific portion develops a color corresponding to a sum of the quantities of thermal energy per unit area applied to the specific portion.

<Temporary Halt and Restart of Pulse Printing>

The CPU 51 may temporarily halt conveyance of the print medium 3A in the middle of the pulse printing. For instance, when the temperature of the thermal head 31 becomes equal to or higher than a particular temperature, the CPU 51 temporarily halts conveyance of the print medium 3A in the middle of the pulse printing. In this case, in order to cool the thermal head 31 until the temperature of the thermal head 31 becomes equal to or lower than a predetermined temperature by temporarily stopping applying thermal energy to the heating elements 32, the CPU 51 temporarily halts the rotation of the conveyance motor 60, thereby temporarily halting the rotation of the platen roller 26. Thereby, the conveyance of the print medium 3A is temporarily halted. At the same time, the intermittent supply of thermal energy to the print medium 3A is stopped. After the thermal head 31 is cooled until the temperature thereof becomes equal to or lower than the predetermined temperature, the CPU 51 restarts rotating the conveyance motor 60, thereby restarting rotating the platen roller 26. At the same time, the CPU 51 restarts intermittently applying thermal energy to the heating elements 32.

When the conveyance of the print medium 3A is halted and resumed, a rotational acceleration of the platen roller 26 changes. Along with the change in the rotational acceleration of the platen roller 26, the print medium 3A may slip relative to the platen roller 26. In this case, a position of the print medium 3A relative to the platen roller 26 shifts. Hereinafter, this phenomenon may be referred to as a "relative position shift." When the relative position shift occurs, the print medium 3A is over-conveyed even after the platen roller 26 and the conveyance motor 60 have been stopped, and thereafter stops. It is noted that the relative position shift may be caused by other factors than the above reason. For instance, the relative position shift may occur in response to the print medium 3A being cut off after the conveyance of the print medium 3A is halted.

Referring to FIGS. 5 and 6, an explanation will be provided of a plurality of lines L formed on the print medium 3A when the relative position shift occurs in the middle of the pulse printing. It is noted that the CPU 51 is configured to control timings for applying thermal energy to the print medium 3A such that a plurality of lines are formed respectively in mutually-different positions in the sub scanning direction on the print medium 3A when thermal energy is intermittently applied to the print medium 3A a plurality of times in the pulse printing. Specifically, for instance, the CPU 51 controls timings for applying thermal energy to the print medium 3A such that a position in the sub scanning direction of a line formed on the print medium 3A when thermal energy is applied to the print medium 3A at a specific timing for the M-th time (where M is an integer equal to or more than one) is different from a position in the sub scanning direction of a next line formed on the print medium 3A when thermal energy is applied to the print medium 3A at a specific timing for the (M+1)-th time. Accordingly, the plurality of lines formed by intermittently applying thermal energy to the print medium 3A the plurality of times do not overlap each other in the sub scanning direction (i.e., the plurality of lines do not overlap each other with respect to their positions in the sub scanning direction). In other words, the plurality of lines formed by intermittently applying thermal energy to the print medium 3A the plurality of times do not positionally coincide with each other in the sub scanning direction.

In the following description referring to FIGS. 5, 6A, and 6B, it is assumed that a quantity Qr (which is equal to or more than the first quantity Q1 and equal to or less than the second quantity Q2) of thermal energy per unit area is intermittently applied to the print medium (see upper graphs in FIGS. 5, 6A, and 6B). In each of FIGS. 5, 6A, 6B, 8, 9, and 11 (FIGS. 8, 9, and 11 will be described later), for the sake of easy understanding, changes in the relative positional relationship between the print medium 3A and the thermal head 31 are shown by void arrows that indicate movement of the thermal head 31 relative to the print medium 3A. In this case, a portion of the print medium 3A to which the quantity Qr of thermal energy per unit area has been applied (i.e., a contact portion of the print medium that is in contact with each heating element 32) develops the red color. A plurality of red dots d are included in each of the plurality of lines L formed on the print medium 3A. Hereinafter, the color of the plurality of dots d included in each line L may be referred to as a "color of the line L."

FIG. 5 shows a case where the relative position shift occurs when the conveyance of the print medium 3A in the forward direction has been temporarily halted in the middle of the pulse printing (a-1), and thereafter, the conveyance of the print medium 3A in the forward direction is resumed (a-2). In the pulse printing, thermal energy is intermittently applied to the print medium 3A in synchronization with pulse signals transmitted to the conveyance motor 60. At a timing t11 when the rotation of the conveyance motor 60 is halted in response to the transmission of pulse signals to the conveyance motor 60 being stopped, the intermittent supply of thermal energy to the print medium 3A is halted. Along with the occurrence of the relative position shift, the print medium 3A is over-conveyed relative to the platen roller 26 for a particular period of time even after the timing t11 when the supply of thermal energy to the thermal head 31 has been stopped. Afterward, the print medium 3A stops at a timing 12 (a-1). Therefore, on the print medium 3A, an area where thermal energy is applied before the transmission of pulse signals to the conveyance motor 60 is once halted is spaced apart in the sub scanning direction from an area where thermal energy is applied after the transmission of pulse signals to the conveyance motor 60 is resumed (a-2).

Hereinafter, the area of the print medium 3A where thermal energy is applied before the transmission of pulse signals to the conveyance motor 60 is once stopped may be referred to as a "before-stop area Rs." The area of the print medium 3A where thermal energy is applied after the transmission of pulse signals to the conveyance motor 60 is restarted may be referred to as an "after-restart area Rt." An area of the print medium 3A between the before-stop area Rs and the after-restart area Rt may be referred to as a "blank area Rp." In each of the before-stop area Rs and the after-restart area Rt of the print medium 3A, a plurality of red lines L are formed in response to thermal energy being intermittently applied to each of the areas Rs and Rt. Meanwhile, the blank area Rp where thermal energy is not applied does not develop any color. Namely, there is no line L formed in the blank area Rp. Therefore, the blank area Rp appears as a white line in a red image printed on the print medium 3A, and it leads to deterioration of print quality.

<Overview of Connection Process>

A connection process is for avoiding occurrence of the blank area Rp. In the connection process, after the conveyance of the print medium 3A in the forward direction has been once halted, the print medium 3A is conveyed in the backward direction before the conveyance of the print medium 3A in the forward direction is resumed.

FIGS. 6A and 6B show a plurality of lines L formed on the print medium 3A when the connection process is performed in response to occurrence of the relative position shift. FIG. 6A shows a case where the conveyance of the print medium 3A in the forward direction is once halted (b-1), the print medium 3A is conveyed in the backward direction until the thermal head 31 is placed in a position adjacent to the before-stop area Rs (b-2), and thereafter, the conveyance of the print medium 3A in the forward direction is resumed (b-3). In this case, unlike the case exemplified in FIG. 5, the before-stop area Rs and the after-restart area Rt are adjacent to each other without the blank area Rp formed therebetween. Hence, there is no white line appearing in a red image printed on the print medium 3A, and thus, a high level of print quality is maintained.

Nonetheless, the relative position shift might be caused when the conveyance of the print medium 3A in the backward direction is started and stopped. Therefore, the print medium 3A may be over-conveyed in the backward direction even after the platen roller 26 and the conveyance motor 60 have been stopped, and then may be stopped. Accordingly, as shown in FIG. 6A, the print medium 3A might not be conveyed in the backward direction such that the thermal head 31 is accurately placed in the position adjacent to the before-stop area Rs. When the conveyance of the print medium 3A in the backward direction is halted before the thermal head 31 reaches the position adjacent to the before-stop area Rs, the blank area Rp remains. In this case, a white line appears in the printed image. Accordingly, in order to certainly prevent formation of the blank area Rp no matter how much an extent of the relative position shift varies, the print medium 3A is conveyed in the backward direction until the thermal head 31 is placed in a position to overlap the before-stop area Rs.

FIG. 6B shows a case where the conveyance of the print medium 3A in the forward direction is once halted (c-1), the print medium 3A is conveyed in the backward direction until the thermal head 31 is placed in a position to overlap the before-stop area Rs (c-2), and thereafter, the conveyance of the print medium 3A in the forward direction is resumed (c-3). The before-stop area Rs and the after-restart area Rt partially overlap each other. Hereinafter, an overlapping area between the before-stop area Rs and the after-restart area Rt may be referred to as an "overlapping area Rm." To the overlapping area Rm of the print medium 3A, the quantity Qr of thermal energy per unit area is applied before the transmission of pulse signals to the conveyance motor 60 is once halted. Subsequently, to the overlapping area Rm of the print medium 3A, the quantity Qr of thermal energy per unit area is additionally applied after the transmission of pulse signals to the conveyance motor 60 is resumed. Namely, the quantity Qr of thermal energy per unit area is applied twice to the overlapping area Rm of the print medium 3A.

As described with reference to FIG. 4B, when a quantity of thermal energy per unit area is applied to a specific portion of the print medium a plurality of times, the specific portion develops a color corresponding to a sum of the quantities of thermal energy per unit area applied to the specific portion. Therefore, a plurality of lines L formed in the overlapping area Rm (c-2) develop a color corresponding to a sum (Qr×2) of the quantities Qr of thermal energy per unit area applied twice to the area Rm. When the sum (Qr×2) is equal to or more than the third quantity Q3, the overlapping area Rm of the print medium 3A develops the black color. In this case, the color (i.e., red) of a plurality of lines L formed in areas other than the overlapping area Rm of the before-stop area Rs and the after-restart area Rt is different from the color (i.e., black) of the plurality of lines L formed in the overlapping area Rm. Therefore, the overlapping area Rm appears as a black line in a red image printed on the print medium 3A, and it leads to deterioration of print quality.

<First Printing Process>

The CPU 51 performs a first printing process (see FIG. 7) so as to prevent the print quality from being deteriorated by the black line appearing in the red printed image. The first printing process will be described with reference to FIG. 7. In response to an instruction to start a printing operation being input via the input keys 7, the CPU 51 starts the first printing process by reading and executing one or more programs 52A stored in the ROM 52.

The CPU 51 acquires the first print data stored in the flash memory 54 (S110). The CPU 51 generates second print data based on the first print data (S130). As shown in FIG. 8, the first print data includes a plurality of pieces of dot data into which a whole of image data G is resolved to associate each piece of pixel data of the image data G with a corresponding piece of dot data of the first print data. Meanwhile, the second print data includes a plurality of pieces of dot data into which an area Gm, corresponding to the overlapping area Rm, of the image data G is resolved to associate each piece of pixel data of the area Gm with a corresponding piece of dot data of the second print data. In other words, the first print data corresponds to print data for forming a plurality of lines L by applying thermal energy to the before-stop area Rs and an area derived from removing the overlapping area Rm from the after-restart area Rt. The second print data corresponds to print data for forming a plurality of lines L by applying thermal energy to the overlapping area Rm of the print medium 3A.

The CPU 51 defines a first area RE The first area R1 is a partial area of the before-stop area Rs and includes at least the overlapping area Rm. The CPU 51 defines a second area R2. The second area R2 is a partial area of the after-restart area Rt and includes at least the overlapping area Rm. The CPU 51 defines a third area R3. The third area R3 is an area derived from removing the overlapping area Rm from the second area R2. For the sake of easy understanding, FIG. 8 shows respective portions of the image data G that correspond to the first area R1, the second area R2, and the third area R3. It is noted that the first print data acquired in S110 is used as print data for printing on the print medium 3A the respective portions of the image data G that correspond to the first area R1 and the third area R3. Further, the second print data generated in S130 is used as print data for printing on the print medium 3A a portion of the image data G that corresponds to the overlapping area Rm.

As shown in FIG. 7, the CPU 51 acquires the fourth quantity Q4 and the fifth quantity Q5 stored in the ROM 52 (S151). Each of the fourth and fifth quantities Q4 and Q5 represents a quantity of thermal energy per unit area that is applied to the print medium 3A.

Each of the fourth and fifth quantities Q4 and Q5 is more than the first quantity Q1 and less than the second quantity Q2 (see the following expressions (2-1)). The fourth quantity Q4 is equal to the fifth quantity Q5 (see the following expression (2-2)). Each of the fourth and fifth quantities Q4 and Q5 is less than the third quantity Q3 divided by two (see the following expressions (2-3)). The fourth quantity Q4 plus the fifth quantity Q5 is less than the third quantity Q3 (see the following expression (2-4)). Specifically, the fourth quantity Q4 plus the fifth quantity Q5 is equal to or less than the second quantity Q2 (see the following expression (2-5)). Thus, the fourth quantity Q4 and the fifth quantity Q5 satisfy relationships represented by the following expressions (2-1) to (2-5).

$$Q1<Q4<Q2, Q1<Q5<Q2 \quad (2\text{-}1)$$

$$Q4=Q5 \quad (2\text{-}2)$$

$$Q4<Q3/2, Q5<Q3/2 \quad (2\text{-}3)$$

$$(Q4+Q5)<Q3 \quad (2\text{-}4)$$

$$(Q4+Q5)\leq Q2 \quad (2\text{-}5)$$

The CPU 51 controls the drive circuit 58 to start transmitting pulse signals to the conveyance motor 60. The drive circuit 58 transmits the pulse signals to the conveyance motor 60 to rotate the platen roller 26 in such a direction as to convey the print medium 3A in the forward direction along the conveyance direction. The conveyance motor 60 begins to rotate the platen roller 26. Thereby, the print medium 3A begins to be conveyed in the forward direction (S170).

The CPU 51 performs the subsequent steps S190 and S211 based on the first print data acquired in S110, while the print medium 3A is being conveyed in the forward direction. The CPU 51 performs the pulse printing on an area derived from removing the first area R1 (see FIG. 8) from the before-stop area Rs of the print medium 3A (S190). At this time, the CPU 51 controls an energization quantity for energizing the heating elements 32 of the thermal head 31 in such a manner that the quantity Qr of thermal energy per unit area is applied to the print medium 3A. A plurality of red lines are formed in the area other than the first area R1, of the before-stop area Rs of the print medium 3A (see FIG. 8, (d-1)).

After completion of the pulse printing on the area other than the first area R1, of the before-stop area Rs of the print medium 3A, the CPU 51 performs the pulse printing on the first area R1 of the print medium 3A (S211). At this time, the CPU 51 controls the energization quantity for energizing the heating elements 32 of the thermal head 31 in such a manner that the fourth quantity Q4 of thermal energy per unit area is applied to the print medium 3A. The fourth quantity Q4 satisfies the relationship represented by the aforementioned expressions (2-1). Therefore, a plurality of red lines L are formed in the first area R1 of the print medium 3A (see FIG. 8, (d-1)).

After completion of the pulse printing on the first area R1 of the print medium 3A, the CPU 51 controls the drive circuit 58 to stop transmission of pulse signals to the conveyance motor 60, thereby halting the rotation of the conveyance motor 60. At the same time, the CPU 51 halts the intermittent supply of thermal energy to the print medium 3A. Further, in response to the conveyance motor 60 being stopped, the platen roller 26 is stopped, and the conveyance of the print medium 3A in the forward direction is halted (S230). When the relative position shift occurs, the print medium 3A is over-conveyed even after the timing when the conveyance motor 60 and the platen roller 26 have been stopped, and thereafter, the print medium 3A stops. Therefore, as shown in an illustration (d-1) of FIG. 8, the thermal head 31 is placed in a position spaced apart from the before-stop area Rs of the print medium 3A in the sub scanning direction.

The CPU 51 controls the drive circuit 58 to start transmitting pulse signals to the conveyance motor 60. The drive circuit 58 transmits pulse signals to the conveyance motor 60 to rotate the platen roller 26 in such a direction as to convey the print medium 3A in the backward direction along the conveyance direction. The conveyance motor 60 begins to rotate the platen roller 26. Thereby, the print medium 3A begins to be conveyed in the backward direction (S250). After the print medium 3A has been conveyed over a particular distance in the backward direction, the CPU 51 halts the transmission of pulse signals from the drive circuit 58 to the conveyance motor 60, thereby stopping the conveyance motor 60. In response to the rotation of the conveyance motor 60 being stopped, the rotation of the platen roller 26 is stopped, and the conveyance of the print medium 3A in the backward direction is halted (S270). At this time, the print medium 3A is conveyed in the backward direction until the thermal head 31 is placed in a position to overlap the before-stop area Rs (see FIG. 8, (d-2)).

The CPU 51 controls the drive circuit 58 to start transmitting pulse signals to the conveyance motor 60. The drive circuit 58 transmits the pulse signals to the conveyance motor 60 to rotate the platen roller 26 in the direction for conveying the print medium 3A in the forward direction along the conveyance direction. The conveyance motor 60 begins to rotate the platen roller 26. Thereby, the print medium 3A begins to be conveyed in the forward direction (S290).

The CPU 51 performs the pulse printing on the second area R2 of the print medium 3A while the print medium 3A is being conveyed in the forward direction (S310). Specifically, the CPU 51 first performs the pulse printing on the overlapping area Rm of the second area R2 based on the second print data generated in S130. Subsequently, the CPU 51 performs the pulse printing on the third area R3 of the second area R2 based on the first print data acquired in S110. At this time, the CPU 51 controls the energization quantity for energizing the heating elements of the thermal head 31 such that the fifth quantity Q5 of thermal energy per unit area is applied to the print medium 3A.

As described above, in S211, the fourth quantity Q4 of thermal energy per unit area has been applied to the overlapping area Rm of the print medium 3A. Namely, the overlapping area Rm has been supplied twice with thermal energy in the two steps S211 and S310. The overlapping area Rm develops a color corresponding to a sum (Q4+Q5) of the quantities of thermal energy per unit area applied thereto. It is noted that the value obtained by adding the fifth quantity Q5 to the fourth quantity Q4 satisfies the relationships represented by the aforementioned expressions (2-4) and (2-5). Hence, a plurality of red lines L are formed in the overlapping area Rm of the print medium 3A (see FIG. 8, (d-3)).

After completion of the pulse printing on the second area R2 of the print medium 3A, the CPU 51 performs the pulse printing on the area other than the second area R2, of the after-restart area Rt of the print medium 3A, based on the first print data acquired in S110 (S330). At this time, the CPU 51 controls the energization quantity for energizing the heating elements 32 of the thermal head 31 such that the quantity Qr of thermal energy per unit area is applied to the print medium 3A. A plurality of lines L including one or more red lines L are formed in the area other than the second area R2, of the after-restart area Rt of the print medium 3A (see FIG. 8, (d-3)).

After completion of the pulse printing on the area other than the second area R2, of the after-restart area Rt of the print medium 3A, the CPU 51 stops the transmission of pulse signals from the drive circuit 58 to the conveyance motor 60, thereby stopping the rotation of the conveyance motor 60. At the same time, the CPU 51 halts the intermittent supply of thermal energy to the print medium 3A. In response to the rotation of the conveyance motor 60 being stopped, the rotation of the platen roller 26 is stopped, and the conveyance of the print medium 3A in the forward direction is halted (S350). The CPU 51 terminates the first printing process.

Operations and Advantageous Effects of First Illustrative Embodiment

As described above, the CPU 51 of the printer 1 applies the fourth quantity Q4 of thermal energy per unit area to the first area R1 of the print medium 3A, and applies the fifth quantity Q5 of thermal energy per unit area to the second area R2 of the print medium 3A. Thereby, the CPU 51 forms a plurality of red lines in each of the first and second areas R1 and R2 of the print medium 3A. The first area R1 and the second area R2 overlap each other in the overlapping area Rm. In this situation, the CPU 51 adjusts the fourth quantity Q4 and the fifth quantity Q5 in such a manner that the value (Q4+Q5) obtained by adding the fifth quantity Q5 to the fourth quantity Q4 is less than the third quantity Q3 (see the expression (2-4)). Therefore, the sum (Q4+Q5) of the quantities of thermal energy per unit area applied to the overlapping area Rm is not equal to or more than the third quantity Q3. In this case, the lines formed in the overlapping area Rm are not black lines. Accordingly, it is possible to prevent the overlapping area Rm from developing the black color and prevent deterioration of print quality of the red printed image.

The CPU 51 performs the connection process. In the connection process, the CPU 51 performs the pulse printing to form a plurality of red lines in the first area R1 while conveying the print medium 3A in the forward direction (S170, S190, and S211), and thereafter halts the conveyance of the print medium 3A (S230). Subsequently, the CPU 51 once conveys the print medium 3A in the backward direction (S250). Next, the CPU 51 conveys the print medium 3A in the forward direction (S250), and performs the pulse printing to form a plurality of red lines in the second area R2 (S310 and S330). In this case, the first area R1 and the second area R2 at least partially overlap each other, with no blank area Rp formed. Therefore, it is possible to prevent formation of the blank area Rp between the first area R1 and the second area R2, and thus avoid formation of a white line in the printed image.

In the pulse printing, the CPU 51 intermittently energizes the heating elements 32 in synchronization with pulse signals transmitted from the drive circuit 58 to the conveyance motor 60. The heating elements 32 intermittently apply thermal energy to the print medium 3A in synchronization with the print medium 3A being conveyed by the rotation of the platen roller 26. The CPU 51 may control timings for applying thermal energy to the print medium 3A such that the respective positions, in the sub scanning direction, of a plurality of lines formed on the print medium 3A by intermittently applying thermal energy to the print medium 3A a plurality of times are different from each other. In this case, the plurality of lines formed by applying thermal energy to the print medium 3A do not overlap or positionally coincide with each other in the sub scanning direction. Therefore, by adjusting the quantity of thermal energy to be applied to the print medium 3A such that the sum of the fourth quantity Q4 and the fifth quantity Q5 is less than the third quantity Q3 (see the aforementioned expression (2-4)), the CPU 51 is allowed to appropriately prevent the overlapping area Rm from being supplied with a quantity of thermal energy equal to or more than the third quantity Q3. Accordingly, it is possible to avoid formation of black lines in the overlapping area Rm and thereby effectively prevent deterioration of the print quality.

In the pulse printing, when a plurality of lines do not overlap each other, the overlapping area Rm is supplied twice with thermal energy. The quantity of thermal energy per unit area applied to the overlapping area Rm for the first time is the fourth quantity Q4. The quantity of thermal energy per unit area applied to the overlapping area Rm for the second time is the fifth quantity Q5. The CPU 51 adjusts each of the fourth and fifth quantities Q4 and Q5 of thermal energy per unit area such that each of the fourth and fifth quantities Q4 and Q5 is less than the third quantity Q3 divided by two (see the aforementioned expressions (2-3)). In this case, the sum (Q4+Q5) of the fourth quantity Q4 and the fifth quantity Q5 is always less than the third quantity Q3 (see the aforementioned expression (2-4)). Accordingly, it is possible to prevent the sum (Q4+Q5) of the quantities of thermal energy per unit area applied to the overlapping area Rm from being equal to or more than the third quantity Q3. Thus, it is possible to avoid formation of black lines in the overlapping area Rm, and thereby prevent deterioration of the print quality.

When the connection process is not performed, the CPU 51 applies thermal energy to the print medium 3A based on the first print data. Meanwhile, when the connection process is performed, thermal energy is over-applied to the overlapping area Rm in comparison with when the connection process is not performed. However, the first print data does not include print data for applying thermal energy to the overlapping area Rm. The CPU 51 generates the second print data based on the first print data (S130). The CPU 51 uses the first print data as print data for forming a plurality of lines L by applying thermal energy to the first area R1 and the third area R3 of the print medium 3A. The CPU 51 uses the generated second print data as print data for forming a plurality of lines L by applying thermal energy to the overlapping area Rm of the print medium 3A. Therefore, the CPU 51 is enabled to appropriately apply thermal energy to the first area R1, the overlapping area Rm, and the third area R3.

The CPU 51 sets the fourth quantity Q4 and the fifth quantity Q5, each of which is a quantity of thermal energy per unit area applied to the overlapping area Rm of the print medium 3A, to be equal to each other (see the aforementioned expression (2-2)). Thereby, the CPU 51 is allowed to treat each of the fourth quantity Q4 of thermal energy per unit area applied to the first area R1 and the fifth quantity Q5 of thermal energy per unit area applied to the second area R2, as a common quantity to the first and second areas R1 and R2. Accordingly, the CPU 51 is allowed to easily perform control to apply thermal energy to the first area R1 and the second area R2.

The CPU 51 sets the sum (Q4+Q5) of the fourth quantity Q4 and the fifth quantity Q5, each of which is a quantity of thermal energy per unit area applied to the overlapping area Rm of the print medium 3A, to be equal to or less than the second quantity Q2 (see the aforementioned expression (2-5)). In this case, the CPU 51 is allowed to appropriately form a plurality of red lines in the overlapping area Rm. Therefore, the CPU 51 is allowed to form a plurality of red lines over a whole of the first and second areas R1 and R2. Accordingly, the printer 1 is allowed to maintain a high level of print quality.

Second Illustrative Embodiment

A second illustrative embodiment according to aspects of the present disclosure will be described. In the second illustrative embodiment, an overview and an electrical configuration of a printer 1 are substantially the same as those exemplified in the first illustrative embodiment. Further, in the second illustrative embodiment, characteristics of a print medium 3A are substantially the same as those exemplified in the first illustrative embodiment. In the second illustrative embodiment, timer printing is performed instead of the pulse printing. In the following description, it is assumed that a plurality of lines L formed on the print medium 3A in the pulse printing are placed in mutually-different positions (with no mutually-overlapping portion) in the sub scanning direction, respectively.

<Overview of Timer Printing>

In the timer printing, the heating elements 32 are intermittently energized at regular intervals of a particular time period. The timer printing is performed for a particular period of time after the rotation of the conveyance motor 60 is stopped by the transmission of pulse signals to the conveyance motor 60 being halted. Therefore, when the relative position shift occurs, the timer printing is performed for a period of time from when the rotations of the conveyance motor 60 and the platen roller 26 are stopped to when the conveyance of the print medium 3A is halted.

For instance, as shown in an illustration (e-1) of FIG. 9, suppose that when the pulse printing is in execution, at a timing t21, the transmission of pulse signals to the conveyance motor 60 is halted, the conveyance motor 60 stops, and the platen roller 26 stops. Further, suppose that in response to occurrence of the relative position shift, the print medium 3A is over-conveyed while being decelerated, and then stops at a timing t22. In this case, the CPU 51 performs the timer printing during a period of time between the timing t21 and the timing t22. During the period of time, thermal energy is intermittently applied to the print medium 3A by the heating elements 32 at regular intervals of a particular time period. It is noted that a quantity of thermal energy per unit area that is periodically applied to the print medium 3A in the timer printing is the quantity Qr.

While the timer printing is in execution, a plurality of lines L are formed to partially overlap each other (i.e., positionally coincide in part with each other) in the sub scanning direction. Specifically, for instance, a line formed on the print medium 3A when thermal energy is applied to the print medium 3A at a specific timing for the M-th time (where M is an integer equal to or more than one) is positionally coincident in part in the sub scanning direction with a next line formed on the print medium 3A when thermal energy is applied to the print medium 3A at a specific timing for the (M+1)-th time. Further, as a conveyance speed for conveying the print medium 3A is decelerated under a particular level of speed, the plurality of lines L formed in the timer printing overlap each other more densely in the sub scanning direction. Specifically, for instance, as the conveyance speed for the print medium 3A decreases, a mutually-overlapping portion of any two adjacent lines becomes wider in the sub scanning direction.

To an overlapping portion of two or more mutually-overlapping lines formed in the timer printing, the quantity Qr of thermal energy per unit area is redundantly applied. Hereinafter, a number of times that thermal energy is repeatedly applied to the overlapping portion of two or more mutually-overlapping lines will be referred to as a "number of repeatedly-heating times D." Further, the number of repeatedly-heating times D of a most-densely overlapping portion of the plurality of lines L formed in the timer printing will be referred to as a "number of repeatedly-heating times Dm." As described above, when a quantity of thermal energy per unit area is applied to a specific portion of the print medium 3A a plurality of times, the specific portion develops a color corresponding to the sum of the quantities of thermal energy per unit area applied to the specific portion of the print medium 3A. Therefore, as shown in the illustration (e-1) of FIG. 9, the overlapping portion of two or more mutually-overlapping lines develops a color corresponding to a total quantity (Qr×D) of thermal energy per unit area applied to the overlapping portion. It is noted that the total quantity (Qr×D) is derived from multiplying the quantity Qr by the number of repeatedly-heating times D. When the total quantity (Qr×D) is equal to or more than the third quantity Q3, the overlapping portion develops the black color.

When the connection process is performed during the pulse printing and the timer printing in execution, the conveyance of the print medium 3A in the forward direction is once halted (e-1), the print medium 3A is conveyed in the backward direction (e-2), and thereafter, the conveyance of the print medium 3A in the forward direction is resumed (e-3). After restarting conveying the print medium 3A in the forward direction, the CPU 51 performs the pulse printing (e-3).

At a point of time (e-2) before the conveyance of the print medium 3A in the forward direction is resumed, the overlapping area Rm of the print medium 3A has already been supplied with up to a quantity (Qr×Dm) of thermal energy per unit area. When the conveyance of the print medium 3A in the forward direction is resumed, and the pulse printing is performed, the quantity Qr of thermal energy per unit area is further applied. Namely, to the overlapping area Rm of the print medium 3A, up to a quantity (Qr×(Dm+1)) of thermal energy per unit area is applied. The most-densely overlapping portion of a plurality of lines formed in the overlapping area Rm develops a color corresponding to the quantity (Qr×(Dm+1)) of thermal energy per unit area. When the quantity (Qr×(Dm+1)) is equal to or more than the third quantity Q3, the most-densely overlapping portion develops the black color. In this case, at least a part of the overlapping area Rm appears as a black line in a red image printed on the print medium 3A, and it leads to deterioration of print quality.

<Second Printing Process>

The CPU 51 performs a second printing process (see FIG. 10) so as to prevent the print quality from being deteriorated by the black line appearing in the red printed image. The second printing process will be described with reference to FIG. 10. The same steps as those of the first printing process will be provided with the same reference characters, and explanations of the same steps may be simplified or omitted. In response to an instruction to start a printing operation being input via the input keys 7, the CPU 51 starts the second printing process by reading and executing one or more programs 52A stored in the ROM 52.

The CPU 51 acquires the first print data stored in the flash memory 54 (S110). The CPU 51 generates second print data based on the first print data (S130). As shown in FIG. 11, the CPU 51 defines the first area R1. The first area R1 is a partial area of the before-stop area Rs and includes at least the overlapping area Rm. The CPU 51 defines the second area R2. The second area R2 is a partial area of the after-restart area Rt and includes at least the overlapping area Rm. The CPU 51 defines the third area R3. The third area R3 is an area derived from removing the overlapping area Rm from the second area R2.

As shown in FIG. 10, the CPU 51 acquires the number of repeatedly-heating times Dm stored in the ROM 52 (S140). The CPU 51 calculates a fourth quantity Q4 and a fifth quantity Q5 based on the acquired number of repeatedly-heating times Dm. Specifically, the fourth and fifth quantities Q4 and Q5 are determined as values smaller than a value (Q3/(Dm+1)) that is derived from dividing the third quantity Q3 by a value (Dm+1) obtained by adding one to the number of repeatedly-heating times Dm (S152). It is noted that each of the fourth and fifth quantities Q4 and Q5 represents a quantity of thermal energy per unit area that is applied to the print medium 3A. Namely, the fourth quantity Q4 and the fifth quantity Q5 satisfy relationships represented by the following expressions (2-6).

$$Q4<Q3/(Dm+1), Q5<Q3/(Dm+1) \quad (2\text{-}6)$$

Further, the fourth quantity Q4 and the fifth quantity Q5 satisfy the relationships represented by the aforementioned expressions (2-1) to (2-5).

The CPU 51 starts rotating the platen roller 26, and starts conveying the print medium 3A in the forward direction (S170). Based on the first print data acquired in S110, the CPU 51 performs the pulse printing on an area other than the first area R1 (see FIG. 11), of the before-stop area Rs (S190). At this time, the CPU 51 controls an energization quantity for energizing the heating elements 32 of the thermal head 31 such that the quantity Qr of thermal energy per unit area is applied to the print medium 3A. A plurality of red lines L are formed in the area other than the first area R1, of the before-stop area Rs of the print medium 3A (see FIG. 11, (f-1)).

After completion of the pulse printing on the area other than the first area R1, of the before-stop area Rs of the print medium 3A, the CPU 51 halts the transmission of pulse signals from the drive circuit 58 to the conveyance motor 60, thereby stopping the rotation of the conveyance motor 60. Due to occurrence of the relative position shift, the print medium 3A is continuously conveyed in the forward direction even after the conveyance motor 60 and the platen roller 26 have been stopped. Based on the first print data acquired in S110, the CPU 51 performs the timer printing on the first area R1 of the print medium 3A (S212). At this time, the CPU 51 controls the energization quantity for energizing the heating elements 32 of the thermal head 31 such that the fourth quantity Q4 of thermal energy per unit area is applied to the print medium 3A. Afterward, the CPU 51 halts the conveyance of the print medium 3A in the forward direction (S230). The CPU 51 terminates the timer printing.

The CPU 51 starts rotating the conveyance motor 60 and the platen roller 26, and starts conveying the print medium 3A in the backward direction (S250). After the print medium 3A is conveyed over a particular distance in the backward direction, the CPU 51 stops the rotations of the conveyance motor 60 and the platen roller 26, thereby halting the conveyance of the print medium 3A in the backward direction (S270) (see FIG. 11, (f-2)).

The CPU 51 starts rotating the platen roller 26, and starts conveying the print medium 3A in the forward direction (S290). The CPU 51 performs the pulse printing on the second area R2 of the print medium 3A (S310). Specifically, the CPU 51 first performs the pulse printing on the overlapping area Rm of the second area R2, based on the second print data generated in S130. Subsequently, the CPU 51 performs the pulse printing on the third area R3 of the second area R2, based on the first print data acquired in S110. At these times, the CPU 51 controls the energization quantity for energizing the heating elements 32 of the thermal head 31 such that the fifth quantity Q5 of thermal energy per unit area is applied to the print medium 3A.

To the overlapping area Rm, in S212, up to a quantity (Q4×Dm) of thermal energy per unit area has already been applied. When the step S310 is executed, up to a total quantity (Q4×Dm+Q5) of thermal energy per unit area is applied to the overlapping area Rm. The fourth quantity Q4 is equal to the fifth quantity Q5. Hence, in other words, up to a total quantity (Q4×(Dm+1)) of thermal energy per unit area is applied to the overlapping area Rm. The fourth quantity Q4 and the fifth quantity Q5 satisfy the relationships represented by the aforementioned expressions (2-6). Therefore, the quantity (Q4×(Dm+1)) is less than the third quantity Q3. Accordingly, a plurality of red lines are formed in the overlapping area Rm of the print medium 3A (see FIG. 11, (f-3)).

After completion of the pulse printing on the second area R2 of the print medium 3A, the CPU 51 performs the pulse printing on an area other than the second area R2 (see FIG. 11), of the after-restart area Rt of the print medium 3A, based on the first print data acquired in S110 (S330). At this time, the CPU 51 controls the energization quantity for energizing the heating elements 32 of the thermal head 31 such that the quantity Qr of thermal energy per unit area is applied to the print medium 3A. A plurality of red lines are formed in the area other than the second area R2, of the after-restart area Rt of the print medium 3A. The CPU 51 stops the rotation of the platen roller 26, thereby halting the conveyance of the print medium 3A in the forward direction (S350). The CPU 51 stops the pulse printing. The CPU 51 terminates the second printing process.

<Operations and Advantageous Effects of Second Illustrative Embodiment>

The CPU 51 performs the timer printing during the period of time from when the transmission of pulse signals to the conveyance motor 60 is halted to when the platen roller 26 is stopped. When the connection process is performed during the pulse printing and the timer printing in execution, the thermal head 31 is placed in a position adjacent to the before-stop area Rs at a point of time when the conveyance of the print medium 3A in the forward direction is once halted (see FIG. 9, (e-1)). Hence, when the print medium 3A is conveyed in the backward direction (see FIG. 9, (e-2)), the thermal head 31 is always placed in a position to overlap the before-stop area Rs. Further, in the timer printing, the CPU 51 intermittently energizes the heating elements at regular intervals of a particular time period. Therefore, unlike the pulse printing, thermal energy is intermittently applied to the print medium 3A by the heating elements 32, independently of the conveyance of the print medium 3A according to the rotation of the platen roller 26. As the conveyance speed for the print medium 3A decreases while the timer printing is in execution, an interval in the sub scanning direction between adjacent lines formed on the print medium 3A gradually decreases. When the conveyance speed for the print medium 3A is decelerated to be equal to or lower than a particular level of speed, adjacent lines partially overlap each other in the sub scanning direction (i.e., adjacent lines positionally coincide with each other in part in the sub scanning direction). Accordingly, it is possible to form, on the print medium 3A, a plurality of lines densely arranged in the sub scanning direction, and thus achieve a high level of print quality.

To the overlapping area Rm, up to the quantity (Q4×Dm) of thermal energy per unit area has already been applied in the timer printing (S212). When the pulse printing is performed, the fifth quantity Q5 of thermal energy per unit area is further applied to the overlapping area Rm. Therefore, to the overlapping area Rm, up to the total quantity (Q4×Dm+Q5=Q4×(Dm+1)) is applied. The fourth quantity Q4 and the fifth quantity Q5 satisfy the relationships represented by the aforementioned expressions (2-6). Hence, the quantity (Q4×(Dm+1)) is less than the third quantity Q3. Accordingly, a plurality of red lines are formed in the overlapping area Rm of the print medium 3A. Thus, it is possible to prevent the total quantity of thermal energy per unit area applied to the overlapping area Rm from being more than the third quantity Q3. Thereby, it is possible to prevent the print quality from being deteriorated due to the overlapping area Rm developing the black color.

The CPU 51 acquires the number of repeatedly-heating times Dm stored in the ROM 52 (S140). The CPU 51 determines the fourth quantity Q4 and the fifth quantity Q5 to be less than the value (Q3/(Dm+1)) derived from dividing the third quantity Q3 by the value obtained by adding one to the number of repeatedly-heating times Dm. Therefore, it is possible to easily specify the number of repeatedly-heating times Dm, and thereby specify the fourth quantity Q4 and the fifth quantity Q5.

Hereinabove, the illustrative embodiments according to aspects of the present disclosure have been described. The present disclosure can be practiced by employing conventional materials, methodology and equipment. Accordingly, the details of such materials, equipment and methodology are not set forth herein in detail. In the previous descriptions, numerous specific details are set forth, such as specific materials, structures, chemicals, processes, etc., in order to provide a thorough understanding of the present disclosure. However, it should be recognized that the present disclosure can be practiced without reapportioning to the details specifically set forth. In other instances, well known processing structures have not been described in detail, in order not to unnecessarily obscure the present disclosure.

Only exemplary illustrative embodiments of the present disclosure and but a few examples of their versatility are shown and described in the present disclosure. It is to be understood that the present disclosure is capable of use in various other combinations and environments and is capable of changes or modifications within the scope of the inventive concept as expressed herein. For instance, according to aspects of the present disclosure, the following modifications are possible.

Modifications

The aforementioned illustrative embodiments have been described under an assumption that the CPU 51 performs the pulse printing under such control that a plurality of lines are printed not to overlap each other on the print medium 3A. Nonetheless, the CPU 51 may perform the pulse printing under such control that a plurality of lines are printed to overlap each other on the print medium 3A. Further, in the aforementioned illustrative embodiments, the CPU 51 takes control to apply thermal energy to the print medium 3A subject to execution of the connection process. Nonetheless, the connection process may not necessarily be performed. Namely, when performing a printing operation while conveying the print medium 3A in the forward direction, and then halting the conveyance of the print medium 3A, the CPU 51 may resume the printing operation while conveying the print medium 3A in the forward direction, without conveying the print medium 3A in the backward direction. In this case, when the timer printing is performed before the halt of the conveyance of the print medium 3A in the forward direction, the CPU 51 may apply, to the print medium 3A, the fourth quantity Q4 of thermal energy per unit area that satisfies the aforementioned expressions (2-6).

As long as the aforementioned expression (2-4) is satisfied, one of the fourth quantity Q4 and the fifth quantity Q5 may be more than the third quantity Q3 divided by two. Namely, as long as the expression (2-4) is satisfied, the fourth quantity Q4 and the fifth quantity Q5 may not necessarily satisfy the expressions (2-3). Further, as long as the expression (2-4) is satisfied, the fourth quantity Q4 and the fifth quantity Q5 may be different from each other. In other words, as long as the expression (2-4) is satisfied, the fourth quantity Q4 and the fifth quantity Q5 may not necessarily satisfy the expression (2-2). Further, as long as the expression (2-4) is satisfied, the fourth quantity Q4 plus the fifth quantity Q5 may be more than the second quantity Q2. Namely, as long as the expression (2-4) is satisfied, the fourth quantity Q4 and the fifth quantity Q5 may not necessarily satisfy the expressions (2-5).

In S152 of the aforementioned second illustrative embodiment, the CPU 51 may determine the fourth quantity Q4 and the fifth quantity Q5 as values less than a value (Q3/(Dm+n)) derived from dividing the third quantity Q3 by a value (Dm+n) obtained by adding n (n is an integer equal to or more than two) to the number of repeatedly-heating times Dm. The ROM 52 may previously store therein the fourth quantity Q4 and the fifth quantity Q5 determined based on the value (Q3/(Dm+1)) or the value (Q3/(Dm+n)). In this case, the CPU 51 may not execute the aforementioned step S152.

The flash memory 54 may previously store the second print data as well as the first print data. In S310, the CPU 51 may apply thermal energy to the overlapping area Rm based on the second print data stored in the flash memory 54. In this case, the CPU 51 may not generate the second print data based on the first print data. In S310, the CPU 51 may apply thermal energy to the overlapping area Rm based on the first print data. In this case, an image printed on the print medium 3A is smaller by the overlapping area Rm than when thermal energy is applied to the overlapping area Rm based on the second print data in S310.

The color developed when a quantity of thermal energy per unit area that is equal to or more than the first quantity Q1 and equal to or less than the second quantity Q2 is applied to the print medium 3A is not limited to the red color but may be other colors. The color developed when a quantity of thermal energy per unit area that is more than the third quantity Q3 is applied to the print medium 3A is not limited to the black color but may be other colors. Suppose for instance that when a quantity of thermal energy per unit area that is equal to or more than the first quantity Q1 and equal to or less than the second quantity Q2 is applied, the print medium 3A develops a blue color. Further, for instance, suppose that when a quantity of thermal energy per unit area that is more than the third quantity Q3 is applied, the print medium 3A develops a red color. In this case as well, by applying aspects of the present disclosure, it is possible to prevent formation of a white line or a red line in a blue image printed on the print medium 3A.

As the conveyance motor 60 for driving the platen roller 26, a DC motor may be used instead of the pulse motor. In this case, the conveyance motor 60 may be provided with an encoder. The CPU 51 may identify a rotation amount of the conveyance motor 60 based on signals output from the encoder. When performing the pulse printing, the CPU 51 may perform timing control for applying thermal energy to the print medium 3A, based on the identified rotation amount.

What is claimed is:

1. A printer comprising:

a thermal head having a plurality of heating elements arranged in an arrangement direction, the thermal head being configured to selectively energize the plurality of heating elements, thereby applying thermal energy to a print medium, wherein the print medium is configured to develop a first color when supplied with a quantity of thermal energy per unit area that is equal to or more than a first quantity and equal to or less than a second quantity and to develop a second color when supplied with a quantity of thermal energy per unit area that is equal to or more than a third quantity more than the second quantity;

a conveyor configured to convey the print medium in a conveyance direction perpendicular to the arrangement direction of the heating elements; and a controller configured to perform a particular process comprising:

while controlling the conveyor to convey the print medium, controlling the thermal head to apply a fourth quantity of thermal energy per unit area to a first area of the print medium; and while controlling the conveyor to convey the print medium, controlling the thermal head to apply a fifth quantity of thermal energy per unit area to a second area of the print medium, the second area including an overlapping area that overlaps and positionally coincides with at least a part of the first area in the conveyance direction, each of the fourth quantity and the fifth quantity being more than the first quantity and less than the second quantity, a sum of the fourth quantity and the fifth quantity being less than the third quantity.

2. The printer according to claim 1, wherein the particular process further comprises:

while controlling the conveyor to convey the print medium in a forward direction along the conveyance direction, controlling the thermal head to apply the fourth quantity of thermal energy per unit area to the first area of the print medium;

after the print medium is conveyed in the forward direction, controlling the conveyor to convey the print medium in a backward direction opposite to the forward direction; and after the print medium is conveyed in the backward direction, while controlling the conveyor to convey the print medium in the forward direction, controlling the thermal head to apply the fifth quantity of thermal energy per unit area to the second area of the print medium.

3. The printer according to claim 2, wherein the particular process further comprises:

while controlling the conveyor to convey the print medium in the forward direction, controlling the thermal head to intermittently apply the fourth quantity of thermal energy per unit area a plurality of times to the first area of the print medium, in such a manner that an area to which the fourth quantity of thermal energy per unit area is applied for an N-th time is positionally different from an area to which the fourth quantity of thermal energy per unit area is applied for an (N+1)-th time, where N is an integer equal to or more than one; and after the print medium is conveyed in the backward direction, while controlling the conveyor to convey the print medium in the forward direction, controlling the thermal head to intermittently apply the fifth quantity of thermal energy per unit area a plurality of times to the second area of the print medium, in such a manner that an area to which the fifth quantity of thermal energy per unit area is applied for an M-th time is positionally different from an area to which the fifth quantity of thermal energy per unit area is applied for an (M+1)-th time, where M is an integer equal to or more than one.

4. The printer according to claim 3, wherein each of the fourth quantity and the fifth quantity is less than the third quantity divided by two.

5. The printer according to claim 2, wherein the particular process further comprises:

while controlling the conveyor to convey the print medium in the forward direction, controlling the thermal head to intermittently apply the fourth quantity of thermal energy per unit area a plurality of times to the first area of the print medium, in such a manner that an area to which the fourth quantity of thermal energy per unit area is applied for an N-th time partially overlaps an area to which the fourth quantity of thermal energy per unit area is applied for an (N+1)-th time, where N is an integer equal to or more than one; and after the print medium is conveyed in the backward direction, while controlling the conveyor to convey the print medium in the forward direction, controlling the thermal head to intermittently apply the fifth quantity of thermal energy per unit area a plurality of times to the second area of the print medium, in such a manner that an area to which the fifth quantity of thermal energy per unit area is applied for an M-th time is positionally different from an area to which the fifth quantity of thermal energy per unit area is applied for an (M+1)-th time, where M is an integer equal to or more than one.

6. The printer according to claim 5, wherein each of the fourth quantity and the fifth quantity is less than the third quantity divided by a value obtained by adding one to a number of repeatedly-heating times, the number of repeatedly-heating times being a number of times that the fourth quantity of thermal energy per unit area is repeatedly applied to a specific portion of the first area of the print medium.

7. The printer according to claim 6, further comprising a storage configured to store the number of repeatedly-heating times.

8. The printer according to claim 1, further comprising a memory configured to store first print data for applying thermal energy to the first area and a third area, the third area being an area other than the overlapping area, of the second area, wherein the particular process further comprises:

generating second print data for applying thermal energy to the overlapping area where the first area and the second area at least partially overlap each other;

while controlling the conveyor to convey the print medium, controlling the thermal head to apply the fourth quantity of thermal energy per unit area to the first area, based on the first print data;

while controlling the conveyor to convey the print medium, controlling the thermal head to apply the fifth quantity of thermal energy per unit area to the overlapping area of the second area, based on the second print data; and while controlling the conveyor to convey the print medium, controlling the thermal head to apply the fifth quantity of thermal energy per unit area to the third area of the second area, based on the first print data.

9. The printer according to claim 1, wherein the fourth quantity is equal to the fifth quantity.

10. The printer according to claim 1, wherein the sum of the fourth quantity and the fifth quantity is equal to or less than the second quantity.

11. The printer according to claim 1, wherein the first color is red, and the second color is black.

12. The printer according to claim 1, wherein the controller comprises:

a processor; and a memory storing processor-executable instructions configured to, when executed by the processor, cause the processor to perform the particular process.

13. A method implementable on a processor coupled with a printer, the printer comprising:

a thermal head having a plurality of heating elements arranged in an arrangement direction, the thermal head being configured to selectively energize the plurality of heating elements, thereby applying thermal energy to a print medium, wherein the print medium is configured to develop a first color when supplied with a quantity of thermal energy per unit area that is equal to or more than a first quantity and equal to or less than a second quantity and to develop a second color when supplied with a quantity of thermal energy per unit area that is equal to or more than a third quantity more than the second quantity; and a conveyor configured to convey the print medium in a conveyance direction perpendicular to the arrangement direction of the heating elements, the method comprising:

while controlling the conveyor to convey the print medium, controlling the thermal head to apply a fourth quantity of thermal energy per unit area to a first area of the print medium; and while controlling the conveyor to convey the print medium, controlling the thermal head to apply a fifth quantity of thermal energy per unit area to a second area of the print medium, the second area including an overlapping area that overlaps and positionally coincides with at least a part of the first area in the conveyance direction, each of the fourth quantity and the fifth quantity being more than the first quantity and less than the second quantity, a sum of the fourth quantity and the fifth quantity being less than the third quantity.

14. A non-transitory computer-readable medium storing computer-readable instructions that are executable by a processor coupled with a printer, the printer comprising:

a thermal head having a plurality of heating elements arranged in an arrangement direction, the thermal head being configured to selectively energize the plurality of heating elements, thereby applying thermal energy to a print medium, wherein the print medium is configured to develop a first color when supplied with a quantity of thermal energy per unit area that is equal to or more than a first quantity and equal to or less than a second quantity and to develop a second color when supplied with a quantity of thermal energy per unit area that is equal to or more than a third quantity more than the second quantity; and a conveyor configured to convey the print medium in a conveyance direction perpendicular to the arrangement direction of the heating elements, the instructions being configured to, when executed by the processor, cause the processor to perform a particular process comprising:

while controlling the conveyor to convey the print medium, controlling the thermal head to apply a fourth quantity of thermal energy per unit area to a first area of the print medium; and while controlling the conveyor to convey the print medium, controlling the thermal head to apply a fifth quantity of thermal energy per unit area to a second area of the print medium, the second area including an overlapping area that overlaps and positionally coincides with at least a part of the first area in the conveyance direction, each of the fourth quantity and the fifth quantity being more than the first quantity and less than the second quantity, a sum of the fourth quantity and the fifth quantity being less than the third quantity.

* * * * *